US011382362B2

(12) United States Patent
Tsutsui et al.

(10) Patent No.: US 11,382,362 B2
(45) Date of Patent: Jul. 12, 2022

(54) BRASSIERE

(71) Applicant: Asahi Kasei Kabushiki Kaisha, Tokyo (JP)

(72) Inventors: Kouta Tsutsui, Tokyo (JP); Junko Deguchi, Tokyo (JP); Hiroyuki Kinouchi, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 317 days.

(21) Appl. No.: 16/491,323

(22) PCT Filed: Mar. 13, 2018

(86) PCT No.: PCT/JP2018/009800

§ 371 (c)(1),
(2) Date: Sep. 5, 2019

(87) PCT Pub. No.: WO2018/168875

PCT Pub. Date: Sep. 20, 2018

(65) Prior Publication Data

US 2020/0029631 A1 Jan. 30, 2020

(30) Foreign Application Priority Data

Mar. 13, 2017 (JP) ..... JP2017-047539

(51) Int. Cl.
*A41C 3/00* (2006.01)

(52) U.S. Cl.
CPC ..... *A41C 3/0057* (2013.01); *A41C 3/0071* (2013.01)

(58) Field of Classification Search
CPC ..... A41C 3/0057; A41C 3/0071
(Continued)

(56) References Cited

U.S. PATENT DOCUMENTS 2,923,301 A * 2/1960 Di Tullio ..... A41C 3/00 450/60
3,166,077 A * 1/1965 Laguzzi ..... A41C 3/00 450/61

(Continued)

FOREIGN PATENT DOCUMENTS

CN 204104858 U 1/2015
CN 205671502 U 11/2016

(Continued)

OTHER PUBLICATIONS

International Search Report issued in corresponding International Patent Application No. PCT/JP2018/009800 dated Jun. 5, 2018.

(Continued)

*Primary Examiner* — Gloria M Hale
(74) *Attorney, Agent, or Firm* — Morgan, Lewis & Bockius LLP

(57) ABSTRACT

Provided is a brassiere which is supremely comfortable and which has an excellent breast movement mitigation effect, in other words, excellent movement mitigation properties. The brassiere includes a front part which covers right and left breasts of a wearer, a pair of left and right shoulder straps which are connected to an upper part of the front part, and a pair of wing parts arranged on the left and right of the front part, wherein the front part includes a pair of inner cup parts arranged on the wearer side, and a front cup part arranged outside the inner cup parts, the front part includes a reinforced part having a predetermined width, and the ratio (S2/S1) of elongational stress (S2) of the reinforced part of the front part to elongational stress (S1) of a non-reinforced part of the front part is 1.2/1 to 700/1.

18 Claims, 22 Drawing Sheets

(58) Field of Classification Search
USPC ..... 450/60
See application file for complete search history.

(56) References Cited

U.S. PATENT DOCUMENTS

| | | | | |
|---|---|---|---|---|
| 8,187,053 | B2 * | 5/2012 | Haworth | A41C 3/0021 450/59 |
| 8,523,629 | B2 | 9/2013 | Pundyk | |
| 9,854,852 | B2 * | 1/2018 | Yuasa | A41C 3/0007 |
| 2009/0081924 | A1 * | 3/2009 | Puyaubreau | A41C 3/0057 450/39 |
| 2012/0244782 | A1 | 9/2012 | Pundyk | |

FOREIGN PATENT DOCUMENTS

| | | | |
|---|---|---|---|
| JP | 3078610 | U | 7/2001 |
| JP | 2006-104613 | A | 4/2006 |
| JP | 2011-179144 | A | 9/2011 |
| JP | 2011-195999 | A | 10/2011 |
| JP | 2013-023796 | A | 2/2013 |
| JP | 2014-163018 | A | 9/2014 |
| JP | 2015-086497 | A | 5/2015 |
| JP | 2016-186142 | A | 10/2016 |

OTHER PUBLICATIONS

International Preliminary Report on Patentability and Written Opinion issued in corresponding International Patent Application No. PCT/JP2018/009800 dated Sep. 26, 2019.

* cited by examiner

BRASSIERE

FIELD

The present invention relates to a brassiere which reduces breast movement when worn. More specifically, the present invention relates to a brassiere having a breast movement suppression effect when worn without a loss of comfort, i.e., having movement mitigation properties.

BACKGROUND

Significant movement of the breasts is common during activities such as running and jumping, even when a brassiere is worn. Particularly in the case of intense activities such as sports, such movement can become highly significant, which causes discomfort and sagging of the breasts. As a method for mitigating such movement, Patent Literature 1 describes a brassiere which mitigates breast movement by disposing sub-wing parts on a main body thereof in areas extending from parts of cup parts to parts of wing parts, or alternatively, disposing high-tension parts on the upper and lower edges of the cups, and providing shoulder straps having a specific cross-sectional area.

Many types of sports bras have been developed as brassieres for mitigating breast movement. For example, Patent Literature 2 describes a sports bra comprising, on the inside of a front fabric part, a breast outer rim fabric part that wraps around the outer periphery of the breasts from the top part on both sides. Patent Literature 3 proposes a sports brassiere which can control breast movement during exercise by providing a part having a different modulus of elasticity in the main direction of movement and the direction perpendicular to the main direction, along the peripheral edge of a cup portion which receives the breasts of the wearer. In Patent Literature 4, in order to mitigate breast movement, a reinforced part is provided in an area above the bust top position of the cups and across half or more of the circumferential length of the brassiere, so as to be laminated on the brassiere. Patent Literature 5 proposes a sports brassiere in which, in order to support the breasts, a compression panel (reinforced part) that can be attached to and removed from straps is formed so as to cover the cups, and the pressure supporting the chest can be changed by changing the position in which the compression panel is attached.

CITATION LIST

Patent Literature

[PTL 1] Japanese Unexamined Patent Publication (Kokai) No. 2014-163018
[PTL 2] Japanese Unexamined Patent Publication (Kokai) No. 2011-179144
[PTL 3] Japanese Unexamined Patent Publication (Kokai) No. 2006-104613
[PTL 4] Japanese Unexamined Patent Publication (Kokai) No. 2016-186142
[PTL 5] U.S. Pat. No. 8,523,629

SUMMARY

Technical Problem

However, the breast movement mitigation effects during intense exercise such as sports brought about by disposing sub-wing parts, providing high-tension parts on the upper and lower edges of the cups, and specifying the cross-sectional area of the shoulder straps as described in Patent Literature 1 is insufficient.

In Patent Literature 2 and 3, in order to mitigate breast movement, materials having low elasticity are used on the outer rim of the chest, the lower and upper parts of the cups, etc., whereby the pressure tends to be high in those parts, and as a result, comfort is reduced. The combination of comfort and breast movement mitigation effect brought about by merely providing the reinforced parts described in Patent Literature 2 and 3 is insufficient. In Patent Literature 4, though a reinforced part is provided in an area across half or more of the circumferential length of the brassiere, the pressure tends to be high in such reinforced parts, particularly on the sides and the back, whereby comfort is reduced. In Patent Literature 5, though a compression panel (reinforced part) which is can be attached to and removed from the straps is formed so as to cover the cups, since the compression panel and cups are separated in a region from the straps to the sides of the brassiere, the cup sides of the compression panel tend to separate significantly from the body when worn, whereby the breast movement mitigating effect during intense exercise such as sports is insufficient. A brassiere having a high breast movement mitigating effect during exercise, which does not become uncomfortable when worn regularly for long periods of time, and which is comfortable cannot be found at this time.

Thus, development of a brassiere which can reduce the pressure on the breasts, which is comfortable, and which can mitigate breast movement during both light activity and during intense exercise such as sports as a brassiere which can be worn for long periods of time on a daily basis is desired.

The present invention has been conceived of in light of the problems of the prior art described above, and the object of the present invention is to provide a brassiere which can reduce the pressure on the breasts, which has improved comfort, and which can mitigate breast movement during all types of situations, from everyday light activity to intense exercise such as sports, i.e., having excellent movement mitigation properties.

Solution to Problem

As a result of rigorous investigation in order to achieve the above object, the present inventors have discovered that by separating the front part covering the left and right breasts into inner cup parts and a front cup part, and providing a reinforced part having a predetermined width in the front cup part and/or the inner cup parts, the breasts can be wrapped on the wearer side across a wide range when worn, whereby the above object can be achieved. In the front part, which covers the left and right breasts, the inner cup parts directly contact the left and right breasts so as to cover the left and right breasts, and the front cup part is provided more outwardly than the inner cup parts, so as to cover the inner cup parts.

Specifically, the present invention is as described below.

[1]

A brassiere comprising a front part which covers right and left breasts of a wearer, a pair of left and right shoulder straps which are connected to an upper part of the front part, and a pair of wing parts arranged on the left and right of the front part, wherein the front part comprises a pair of inner cup parts arranged on the wearer side, and a front cup part arranged outside the inner cup parts, and the front part comprises a reinforced part having a predetermined width, and the ratio (S2/S1) of elongational stress (S2) of the reinforced part of the front part to elongational stress (S1) of a non-reinforced part of the front part is 1.2/1 to 700/1.

[2]

The brassiere according to [1], wherein the reinforced part of the front part is present in the front cup part, and the ratio (S4/S3) of elongational stress (S4) of the reinforced part of the front cup part to elongational stress (S3) of a non-reinforced part of the front cup part is 2/1 to 700/1.

[3]

The brassiere according to [1] or [2], wherein the reinforced part of the front part is present in the inner cup parts, and the ratio (S6/S5) of elongational stress (S4) of the reinforced part of the inner cup parts to elongational stress (S5) of a non-reinforced part of the inner cup parts is 1.2/1 to 500/1.

[4]

The brassiere according to any one of [1] to [3], wherein the reinforced part is arranged in the front cup part or the inner cup parts at least above a midpoint of a line segment connecting a midpoint of an upper edge of the front cup part or the inner cup parts and a midpoint of a lower edge of the front cup part or the inner cup parts, and the reinforced part occupies at least 10% of an area of an upper part of the front cup part or the inner cup parts.

[5]

The brassiere according to any one of [1] to [4], wherein when curves connecting the connection positions of the left and right shoulder straps with the front part and upper points of the connection positions of the front part with the left and right wing parts are labelled as K and K', respectively, junctions between the front cup part and the inner cup parts are presents in at least 0 to 50% of positions on the curves K and K' from the connection positions of the left and right shoulder straps with the front part toward upper points of the connection positions between the front part and the left and right wing parts.

[6]

The brassiere according to any one of [1] to [5], comprising a cup support part outside the inner cup parts, wherein the ratio (S7/S5) of elongational stress (S7) of the cup support part to elongational stress (S5) of a non-reinforced part of the inner cup parts is 1/1 to 500/1.

[7]

The brassiere according to any one of [1] to [6], comprising a rear part which connects the shoulder straps and the wing parts on a wearer back side.

[8]

The brassiere according to any one of [1] to [7], further comprising sub-wing parts which are disposed so as to overlap the wing parts in a rear direction area from a part of the front part to a part of the wing parts, and the ratio (S9/S8) of elongational stress (S9) of the sub-wing parts to elongational stress (S8) of the wing parts is 0.7/1 to 10/1.

[9]

The brassiere according to [8], wherein the sub-wing parts are provided outside the wing parts.

[10]

The brassiere according to [8] or [9], wherein the sub-wing parts are arranged in the brassiere so as to maximize the length of a line segment L connecting the midpoint of an upper edge of the front part and the midpoint of an upper edge of a connection site between the shoulder straps and the wing parts on the wearer back side, and when a plane S having a normal in the same direction as the line segment is defined, a junction between the sub-wing parts and the front part, the wing parts, the rear part, a hook part, or an under-tape is present in 0 to 40% of positions on the plane from the midpoint of the upper part of the front part of the line segment L toward the midpoint of the upper edge of the connection site, and/or 70 to 100% of positions on the plane, and the sub-wing parts have areas which are not connected with the wing parts.

[11]

The brassiere according to [10], wherein the sub-wing parts are arranged in the brassiere so as to maximize the length of a line segment L connecting the midpoint of the upper edge of the front part with the midpoint of the upper edge of the connection site, when a plane S having a normal in the same direction as the line segment is defined, a junction between the sub-wing parts and the front part, the wing parts, or the rear part is present on the plane in 0 to 40% of positions from the midpoint of the upper edge of the front part on the line segment L toward the midpoint of the upper edge of the connection side and in 70 to 100% of position on the plane, and the sub-wing parts have areas which are not connected with the wing parts.

[12]

The brassiere according to [11], wherein the ratio (S13/S9) of elongational stress (S13) of the rear part to elongational stress (S9) of the sub-wing parts is at least 0.7/1.

[13]

The brassiere according to any one of [1] to [12], wherein the shoulder straps include cylindrical first strap parts and tapered second strap parts arranged inside the first strap parts, first ends of the first strap parts are connected with the front cup part, and first ends of the second strap parts are directly or indirectly connected with the inner cup parts, and second ends of the first strap parts are connected with second ends or portions of the second strap parts.

[14]

The brassiere according to [13], wherein the ratio (S11/S10) of elongational stress (S11) of the second strap parts to elongational stress (S10) of the first strap parts is 1.2/1 to 30/1.

[15]

The brassiere according to any one of [1] to [14], wherein the brassiere is a sports bra.

Advantageous Effects of Invention

According to the present invention, by separating the front part which covers the breasts into inner cup parts and a front cup part, and providing a reinforced part having a predetermined width in specific locations in the front cup part and/or the inner cup parts, a sports bra which can reduce upward and downward (Y-direction) movement, left and right (X-direction) movement, and forward and backward (Z-direction) movement of the breasts in all types of situations from everyday light activity to intense exercise such as sports, and which has an appropriate tightness (pressure) and which is comfortable can be provided.

DESCRIPTION OF EMBODIMENTS

Figure 1:
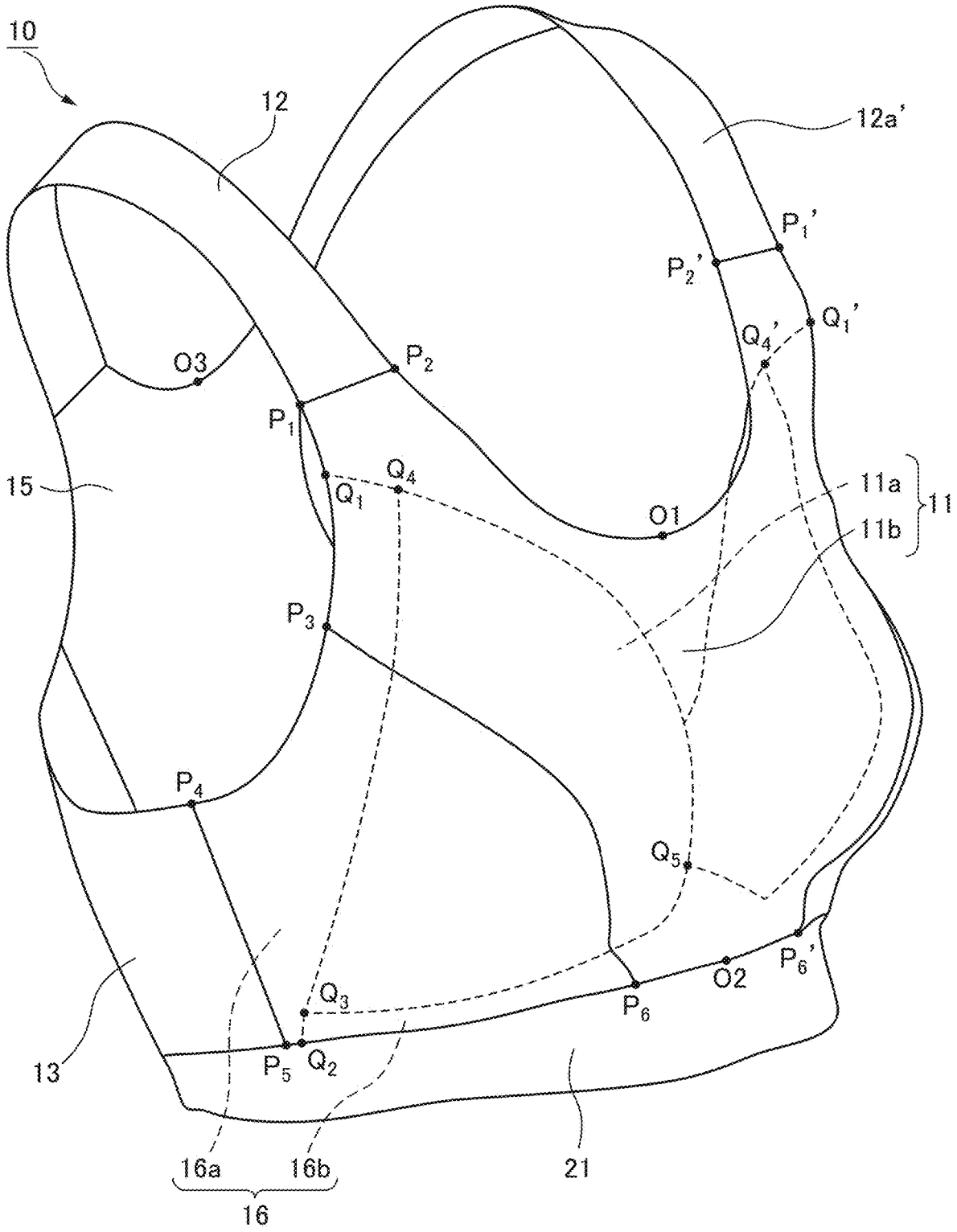
FIG. 1 is a perspective view showing an example of the configuration of the front side of a sports bra according to the present invention.

The embodiments of the present invention will be described below with reference to the attached drawings.

FIGS. 1 to 18 are views showing configuration examples of the sports bra according to the present invention, and FIGS. 19 to 22 are view showing configuration examples of a general brassiere for uses other than sports according to the present invention.

The sports bra (brassiere) according to the present invention comprises a front part which covers the left and right breasts of the wearer, a pair of left and right shoulder straps connected to an upper part of the front part, and a pair of wing parts provided on the left and right of the front part. Further, the sports bra according to the present invention is characterized in that the front part comprises a pair of inner cup parts arranged on the wearer side, and a front cup part outside the inner cup parts, and that a reinforced part having a predetermined width is arranged in the front cup part and/or the inner cup parts. Furthermore, in the embodiments of the present invention, a rear part which connects the shoulder straps and the wing parts on the back side of the wearer may be provided. Since sports bras are often used to mitigate bust movement during exercise and to facilitate movement during exercise such as sports, and general brassieres are often used to improve the appearance of the shape of the breasts, sports bras tend to cover a relatively large area as compared to general brassieres, and often have a structure comprising a front part and wing parts having a large area, wide shoulder straps, and a rear part.

In the present disclosure, "wearer side" refers to the back side of the brassiere (i.e., the side in which the cups are recessed), and "outer side" refers to the side opposite the wearer side.

In the present disclosure, the "horizontal direction" of the brassiere is the direction along which the two cups are arrayed. Specifically, "horizontal direction" means the direction of a straight line connecting the two bust top positions when the brassiere is arranged so that the bust top positions of the two cups are farthest from each other. In the present disclosure, "vertical direction" refers to the direction perpendicular to the horizontal direction, and corresponds to the upward and downward directions of the body of the wearer.

In the present disclosure, "bust top position" means the position corresponding to the top of the bust of the wearer when the brassiere is worn (i.e., a position corresponding to the nipple of the wearer). The bust top positions are the top of the protruding shape (convex shape) of the cups. In the present disclosure, "front center line" and "rear center line" refer to lines extending in the vertical direction of the brassiere through the midpoint of the line segment connecting the two bust top positions. The front center line is a line on the front part, and the rear center is on the wing part, and/or is on the hook part connecting the left and right ring parts on the back side of the wearer when a rear part is not included, and is a line on the rear part when a rear part is included.

Furthermore, in the present disclosure, "reinforced part having a predetermined width" means that the reinforced part is not provided as a line or seam, but is provided as a sheet-like member (fabric) having a predetermined area.

In the present disclosure, when not specifically described, the "elongational stress" is determined in accordance with the cut strip method of JIS L1096.8.14.1A by measuring the stress at 10% elongation in the vertical direction (N/2.5 cm, hereinafter referred to simply as "N") and the stress at 10% elongation in the horizontal direction (N) of a fabric sample cut from a brassiere, and taking the average values thereof (hereinafter referred to as the horizontal/vertical average elongational stress, or simply elongational stress). Note that in the present disclosure, the "vertical direction" of the fabric is arbitrarily set, and the "horizontal direction" is the direction perpendicular thereto. When the fabric is composed of a plurality of layers of fabric, the elongational stress is a value obtained by summing the elongational stresses of the layers fabric, or is a value obtained by measuring the plurality of layers of fabric in a stacked state. In the case of a member which is longer in one direction, such as a shoulder strap, the longer direction is the vertical direction, and the 10% elongational stress in the vertical direction is taken as the elongational stress of the member.

The brassiere basically has a substantially symmetrical structure on the left and right. For example, in the attached drawings, the shoulder strap 12 corresponding to the right side of the wearer and the shoulder strap 12' corresponding to the left side have substantially identical structures. Thus, in the descriptions below, only the shoulder strap 12 is described. Descriptions regarding the shoulder strap 12' are omitted in some cases. The same is true for other constituent elements such as the cup parts and the sub-wing parts 14, as well as reference numerals such as P1 and Q1.

Figure 2:
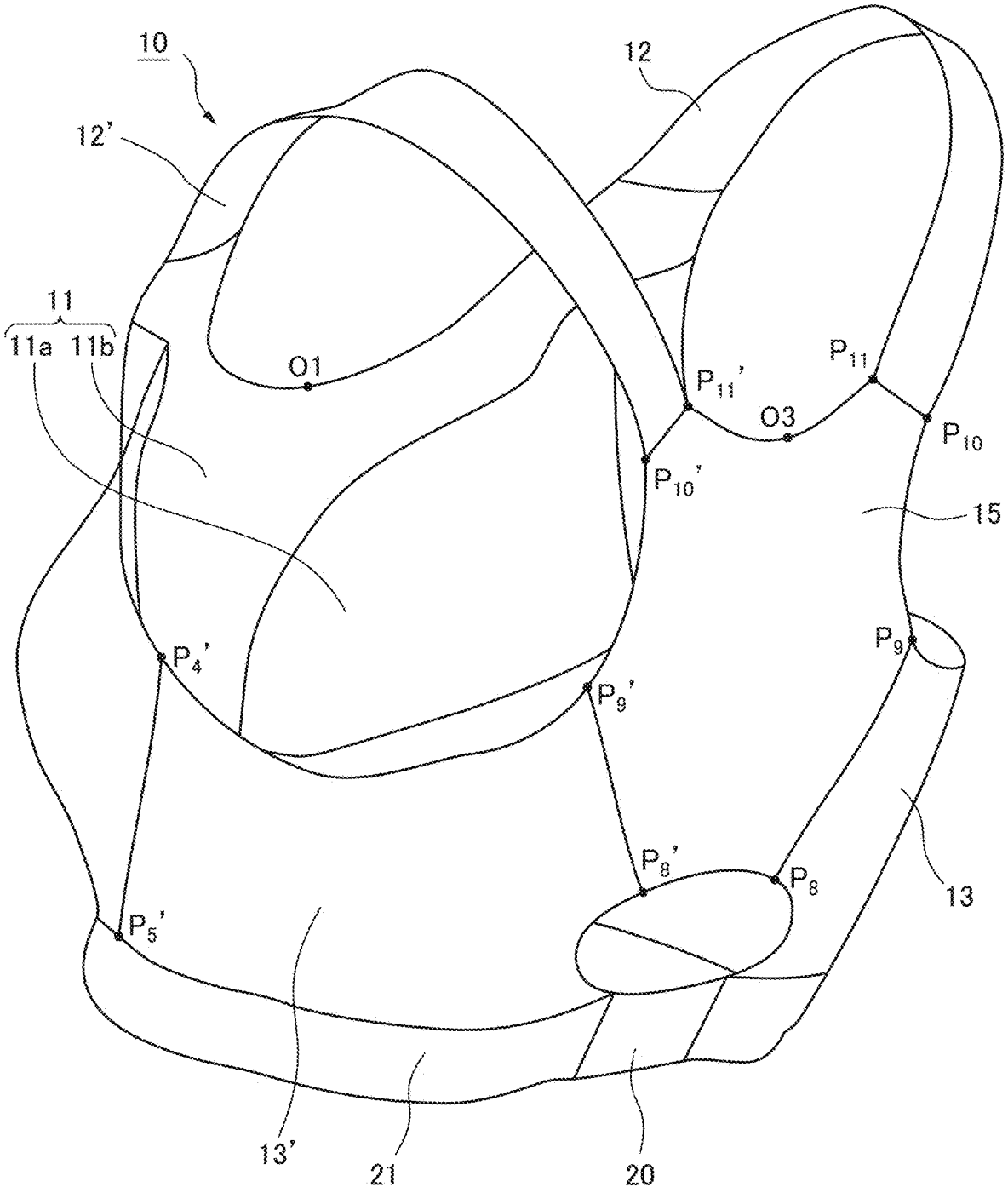
FIG. 2 is a perspective view showing an example of the configuration of the back side of the sports bra according to the present invention.

FIG. 1 is a perspective view showing an example of the configuration of the front side of the sports bra of the present invention, and FIG. 2 is a perspective view showing an example of the configuration of the back side of the sports bra.

Figure 19:
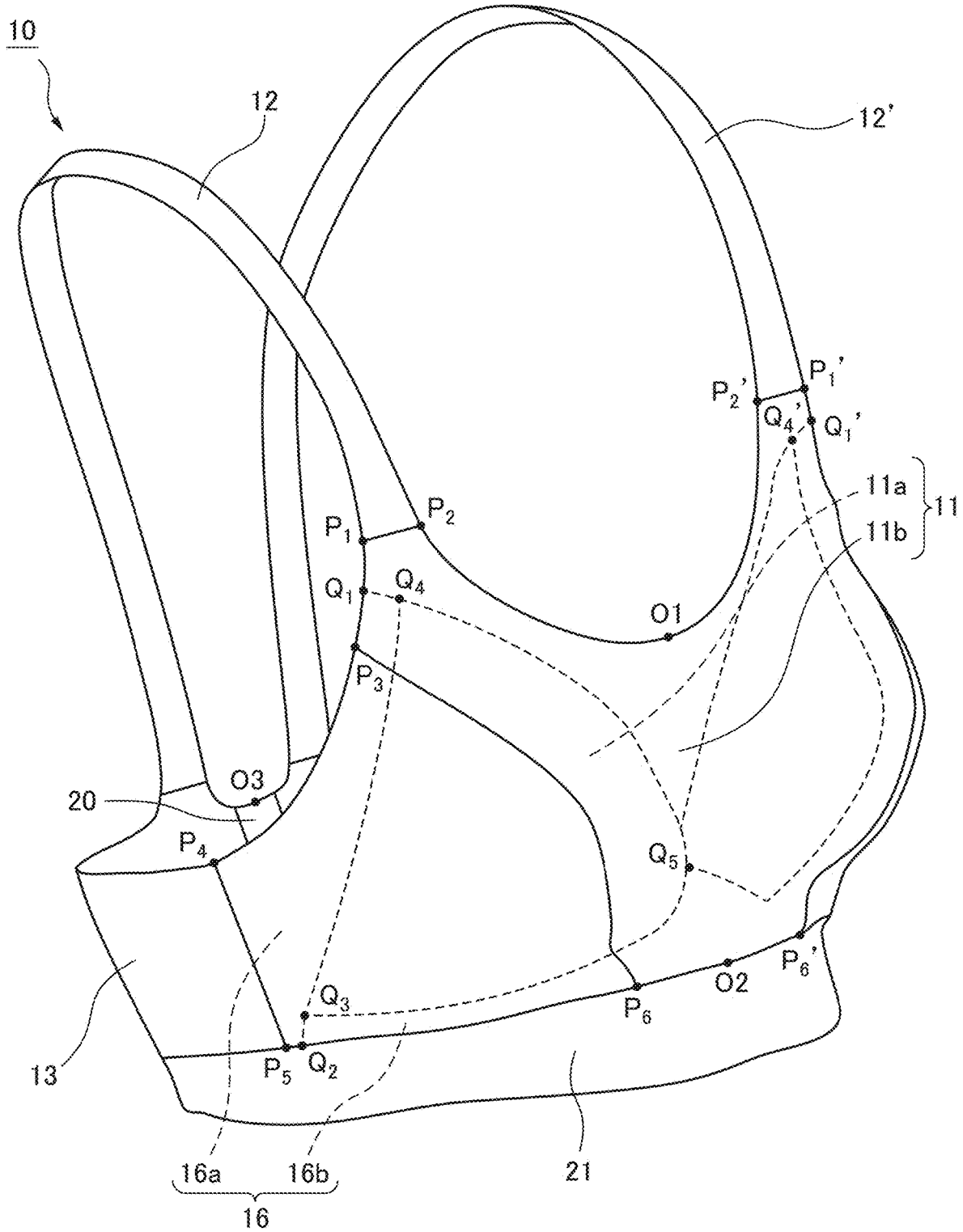
FIG. 19 is a perspective view showing an example of the configuration of the front side of a general brassiere according to the present invention.
Figure 20:
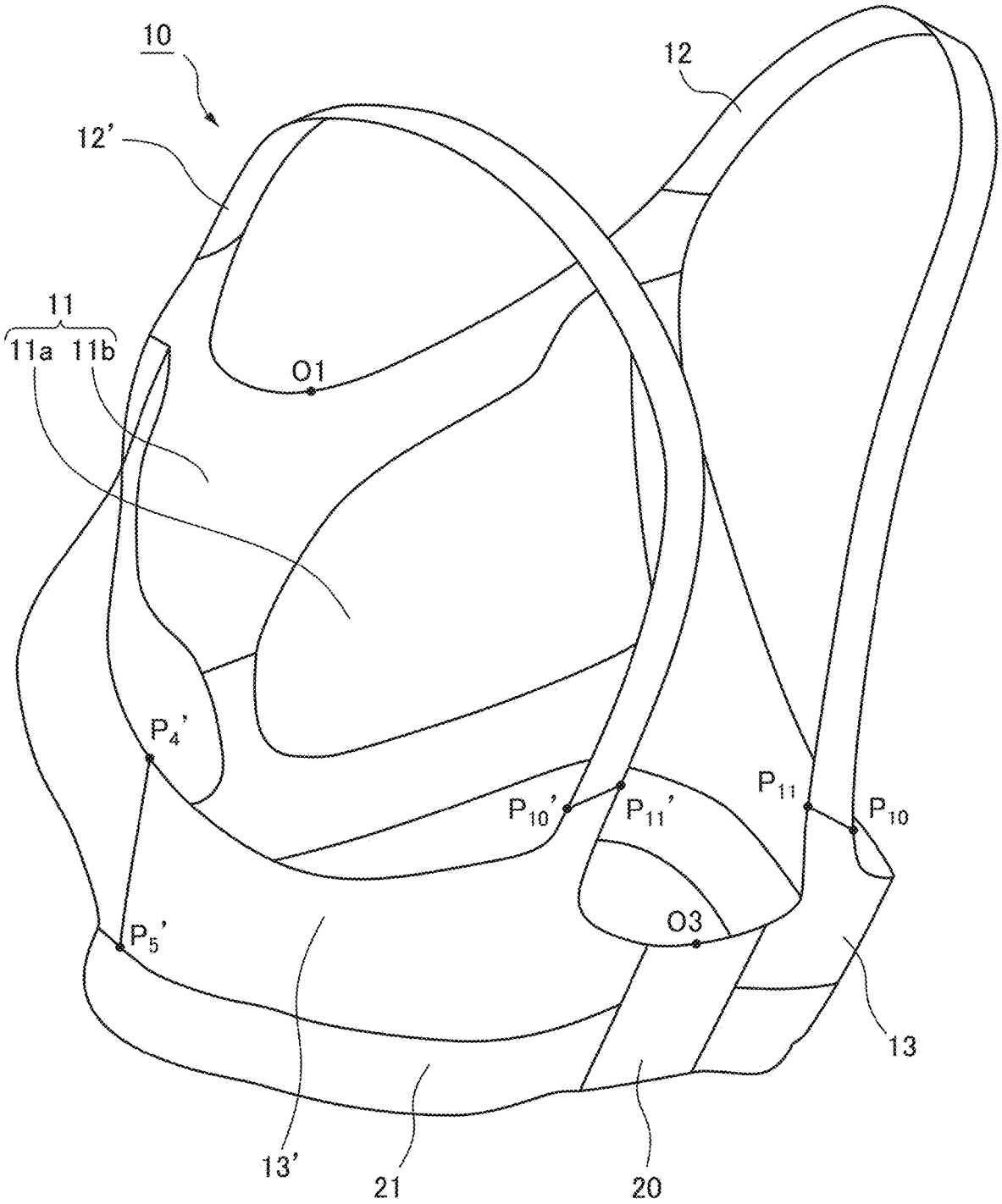
FIG. 20 is a perspective view showing an example of the configuration of the back side of a general brassiere according to the present invention.

As shown in FIGS. 1 and 2, as well as FIGS. 19 and 20, the sports bra (brassiere) 10 according to the present embodiment comprises a front part 11 covering the left and right breasts, left and right shoulder straps 12 which are connected with an upper part of the front part 11, and a pair of wing parts 13 connected on the left and right of the front part 11. Furthermore, in the example shown in FIGS. 1 and 2, a rear part 15 which connects the shoulder straps 12 and the wing parts 13 is provided on the back side of the wearer. The wing parts 13 extend from the side edge parts of the front part 11 toward the back side of the wearer. These members are connected by sewing or the like.

In the embodiments of the present invention, the front part 11 has a double structure comprising a pair of inner cup parts 11*a* provided on the wearer side which receive the left and right breasts of the wearer, and a front cup part 11*b* which is arranged on the outside of the inner cup parts 11*a*.

Figure 3:
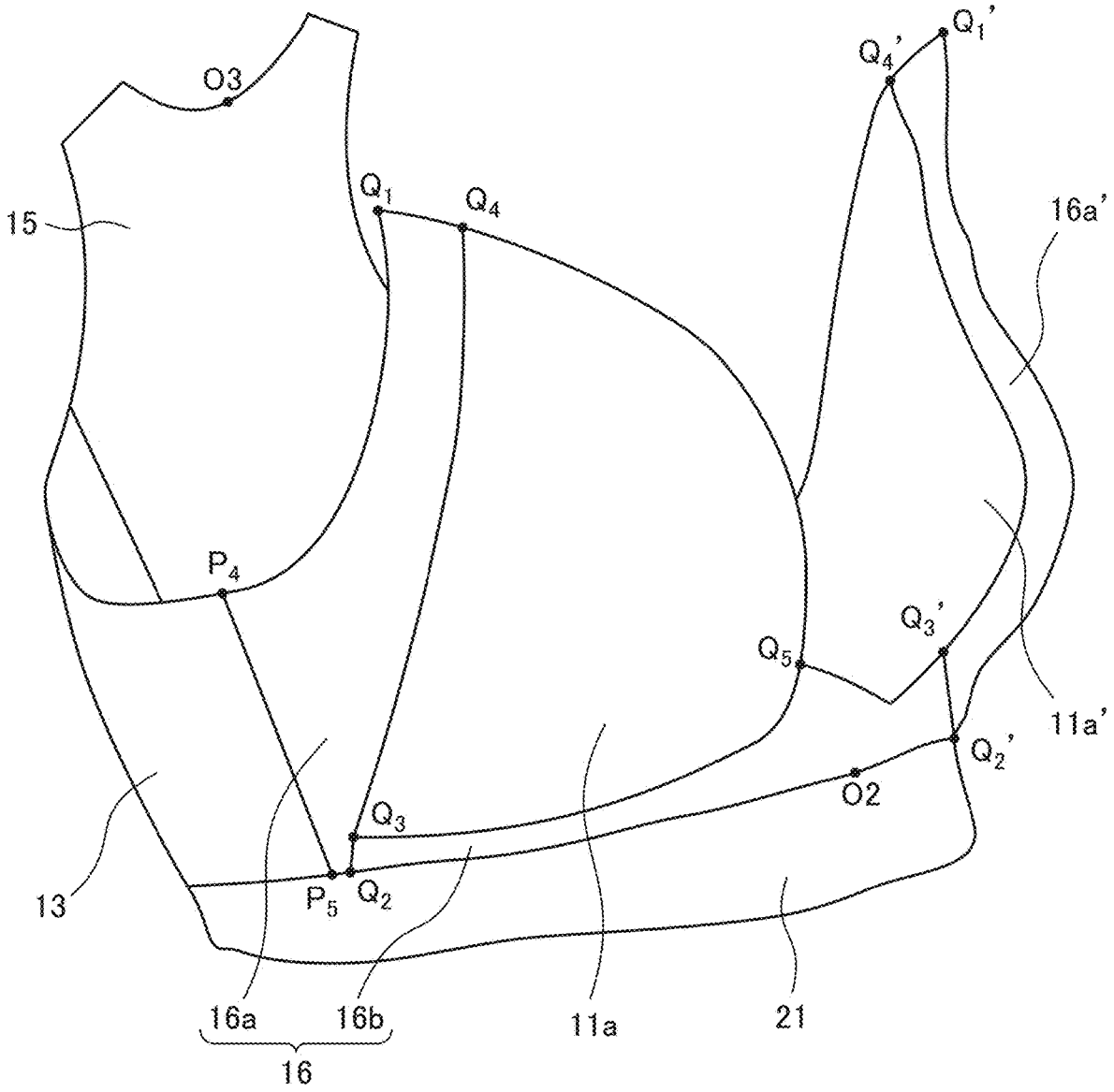
FIG. 3 is a perspective view showing an example of the configuration of inner cup parts of the sports bra shown in FIGS. 1 and 2.
Figure 4:
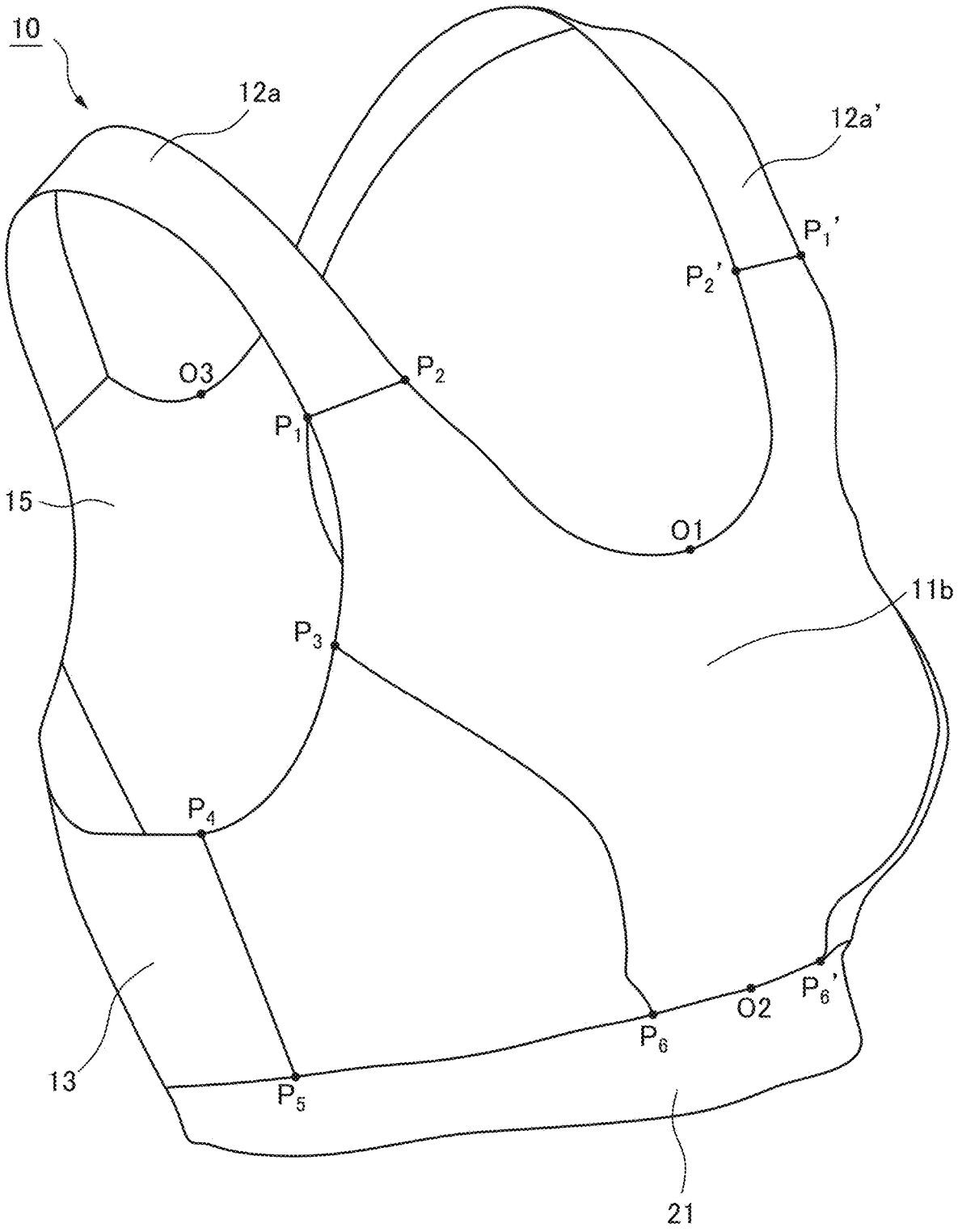
FIG. 4 is a perspective view showing an example of the configuration of a front cup part of the sports bra shown in FIGS. 1 and 2.
Figure 5:
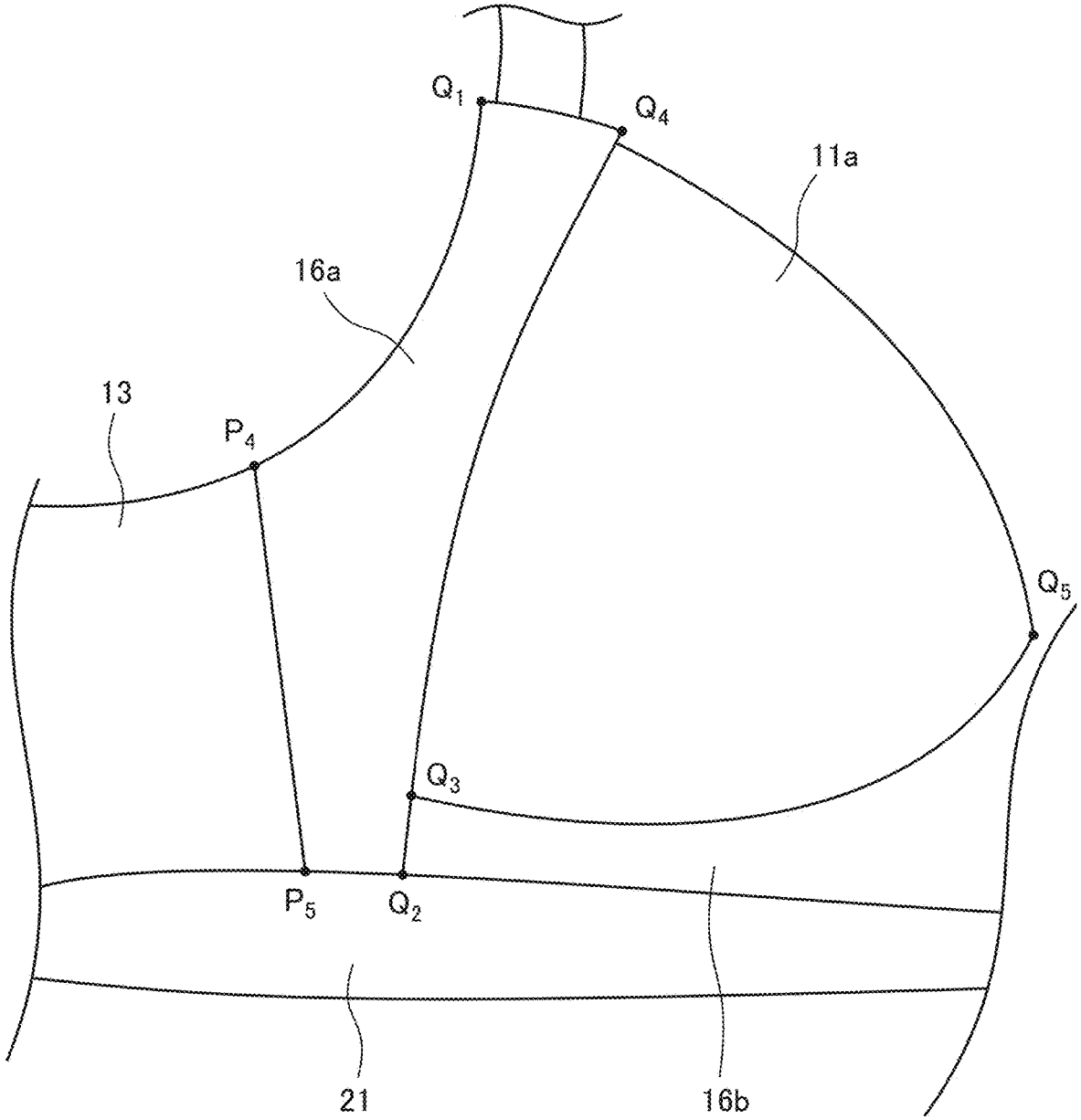
FIG. 5 is a view showing an extracted portion of a first connecting part of the sports bra shown in FIGS. 1 and 2.
Figure 6:
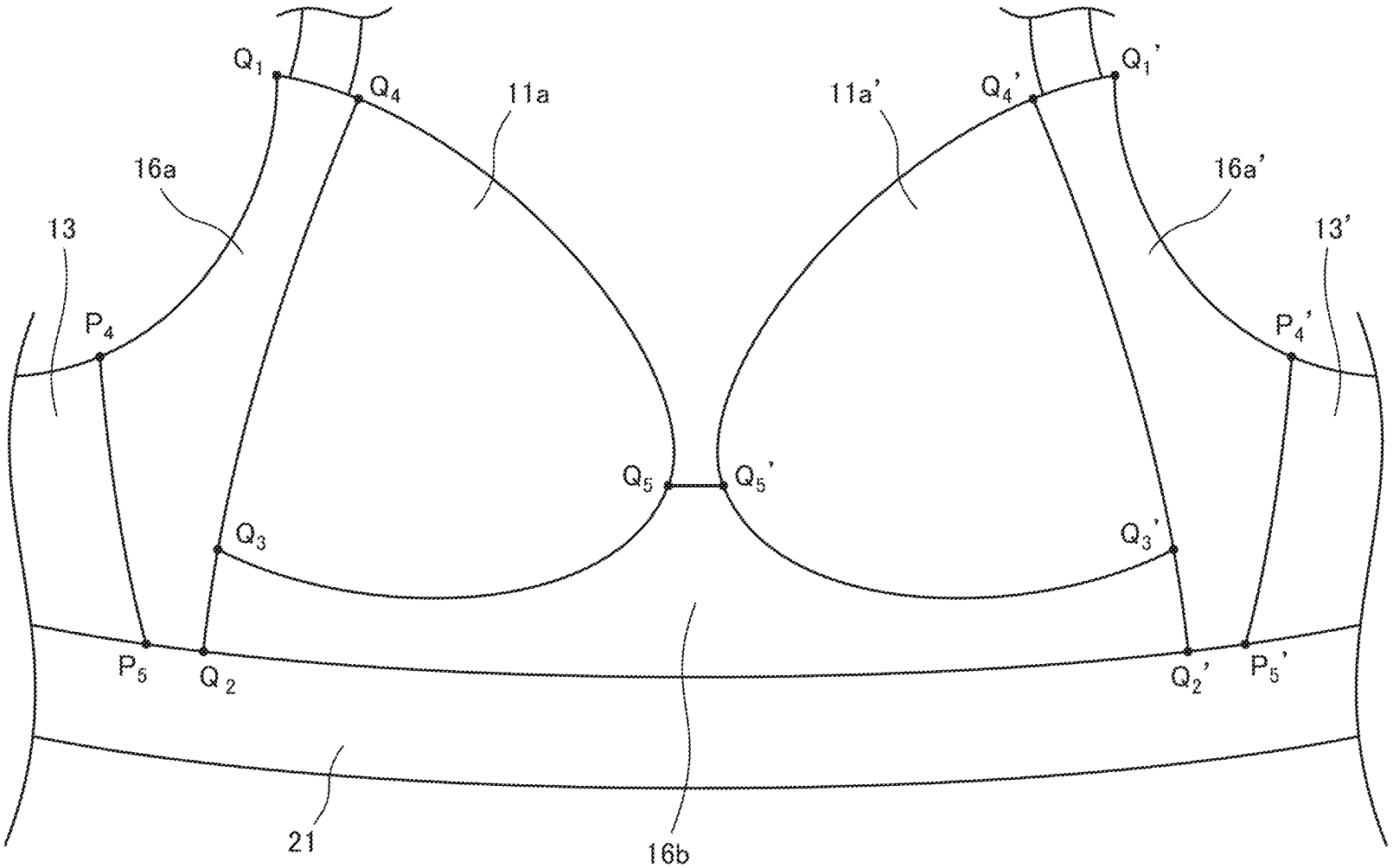
FIG. 6 is a view showing an extracted portion of a second connecting part of the sports bra shown in FIGS. 1 and 2.
Figure 7:
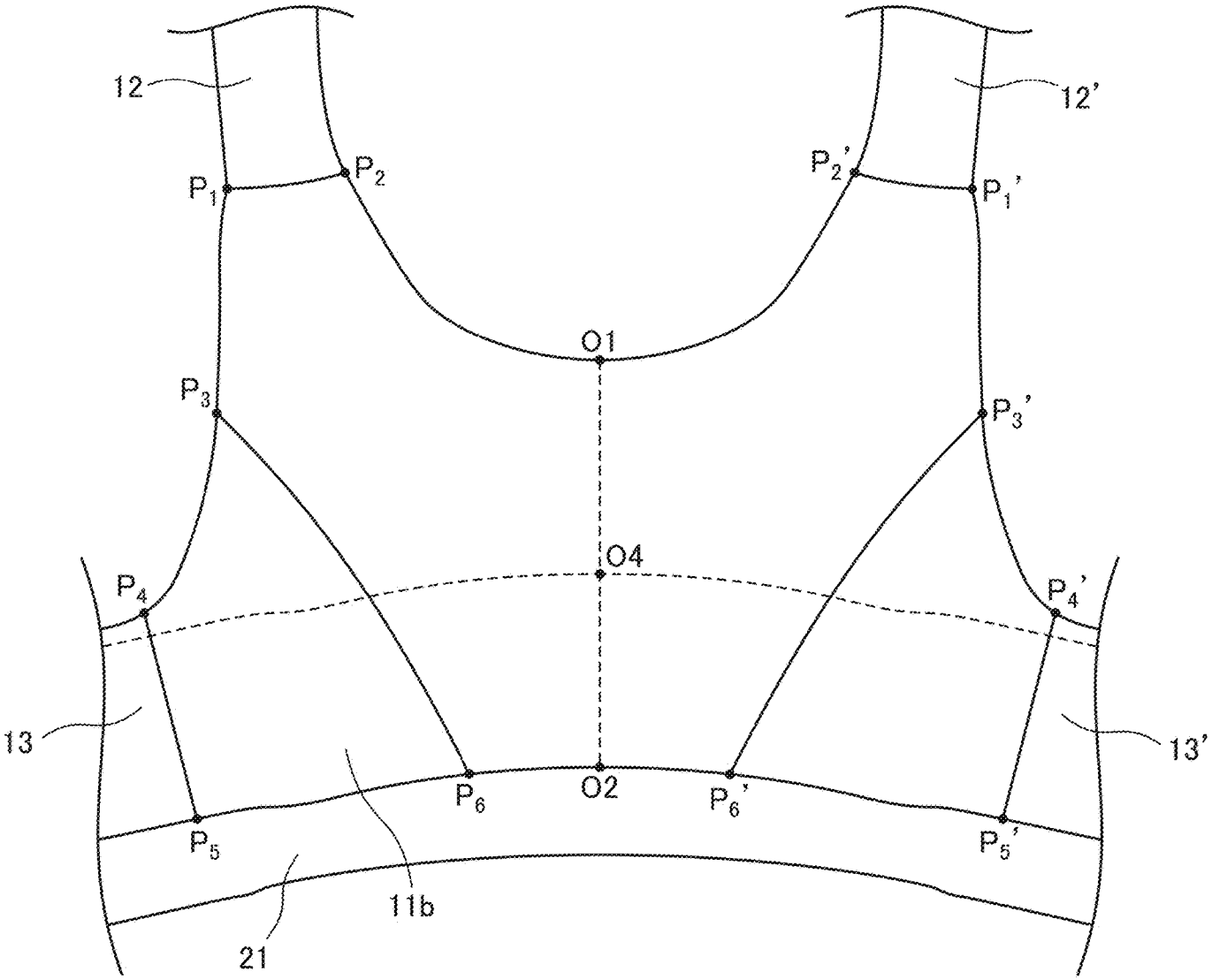
FIG. 7 is a view showing an extracted portion of the front cup part of the sports bra shown in FIGS. 1 and 2.

FIG. 3 is a perspective view showing an example of the configuration of the inner cup parts of the sports bra shown in FIGS. 1 and 2, and FIG. 4 is a perspective view showing an example of the front cup part. FIG. 5 is a view showing an extracted portion of the first connecting part, and FIG. 6 is a view showing an extracted portion of the second connecting part. Furthermore, FIG. 7 is a view showing an extracted portion of the front cup part.

Figure 21:
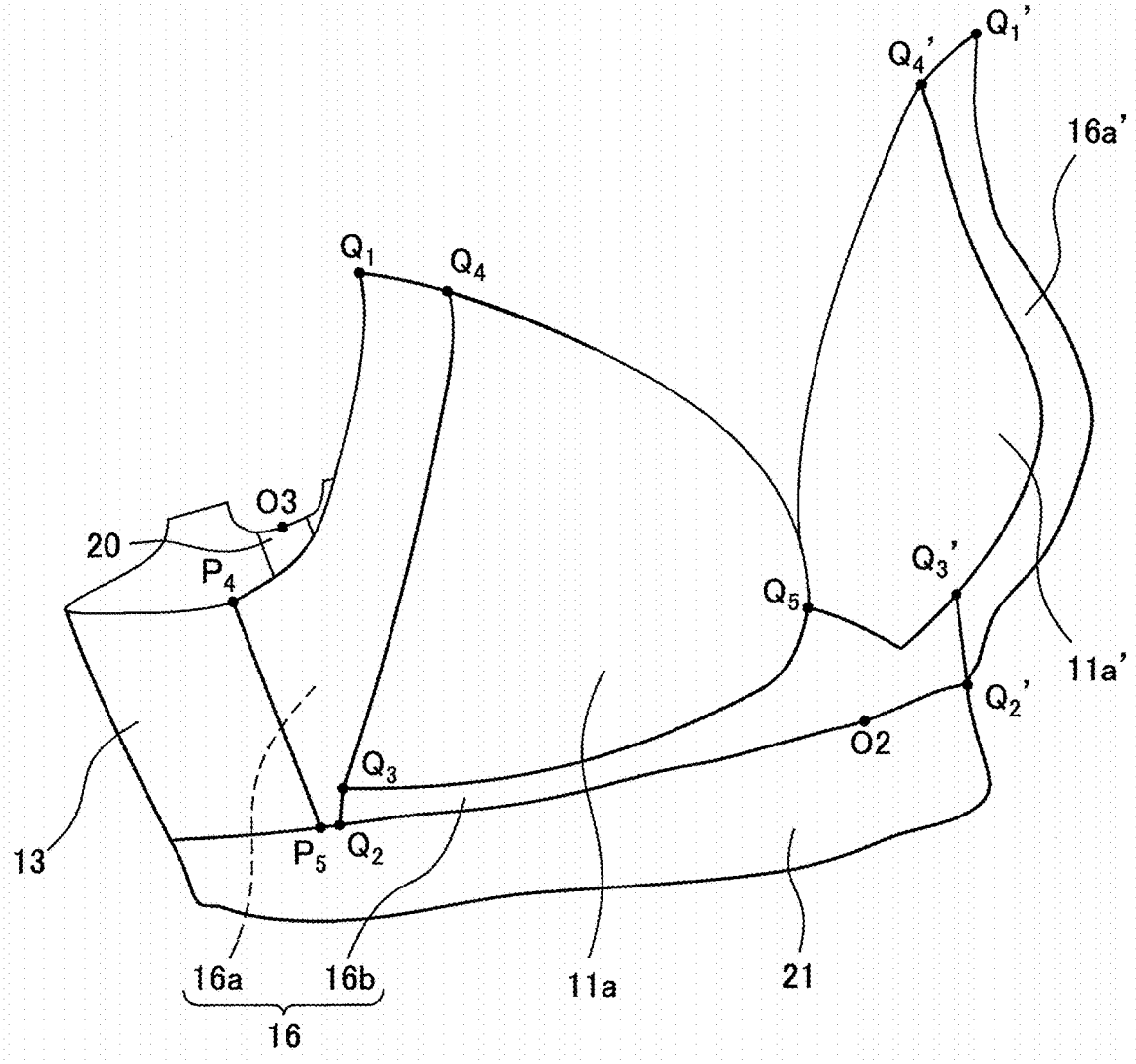
FIG. 21 is a perspective view showing an example of the configuration of the inner cup parts of the brassiere shown in FIGS. 19 and 20.
Figure 22:
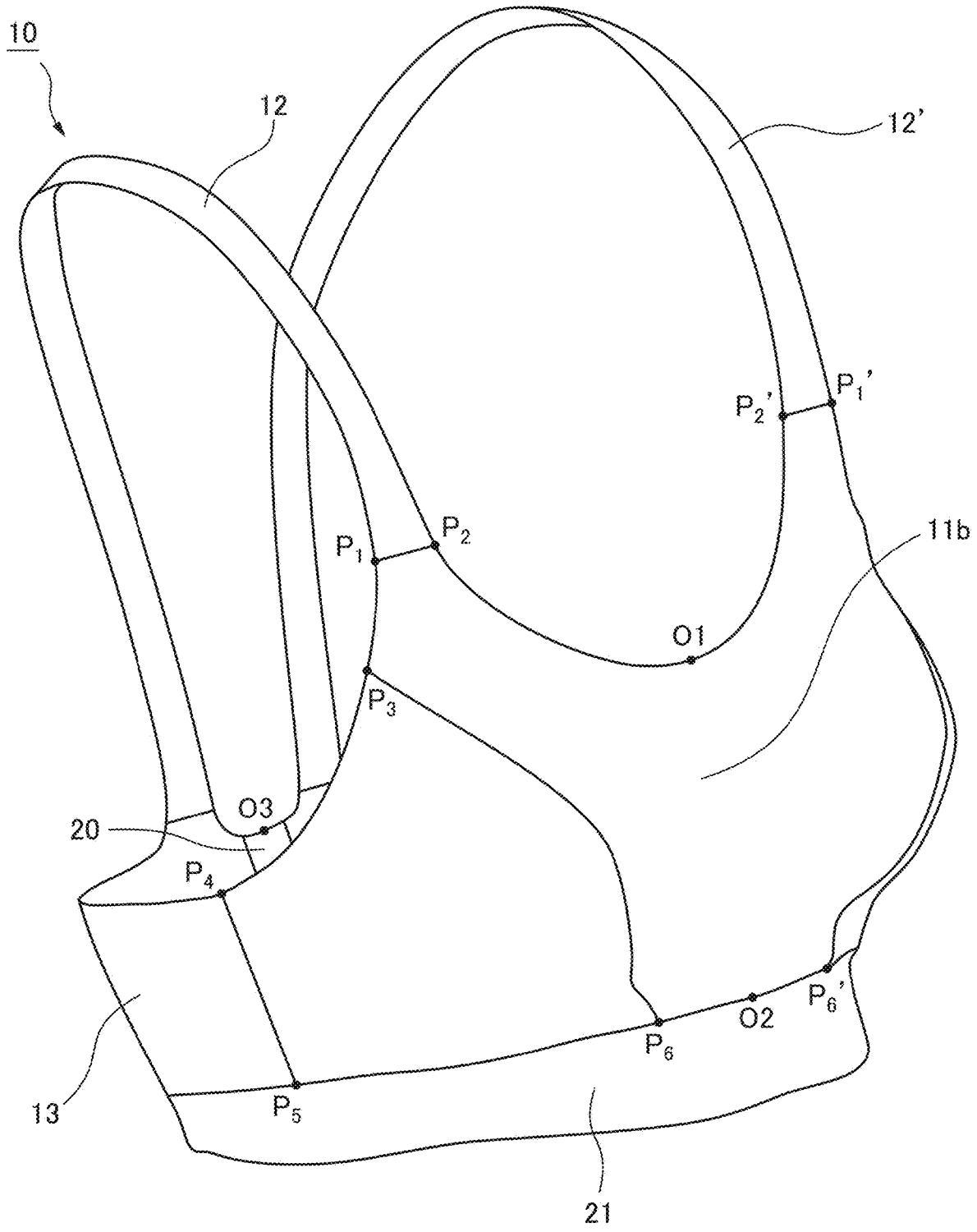
FIG. 22 is a perspective view showing an example of the configuration of the front cup part of the brassiere shown in FIGS. 19 and 20.

FIG. 21 is a perspective view showing an example of the configuration of the inner cup parts of the general brassiere shown in FIGS. 19 and 20, and FIG. 22 is a perspective view showing an example of the configuration of the front cup part.

In the present embodiment, the inner cup part 11*a* is the part bound from Q4 to Q3 to Q5 to Q4 in the drawing, and the front cup part 11*b* is the part bound from P2 to P1 to P3 to P4 to P5 to P6 to P6' to P5' to P4' to P3' to P1' to P2' to P2 in the drawing.

In the example illustrated in the drawing, the inner cup part 11*a* and the front cup part 11*b* are connected on the side edges (edge Q1 to P4 and edge P4 to P5) and the lower edge (P5 to P6 to P6' to P5') via a connecting part 16 (first connecting part 16*a*, second connecting part 16*b*) formed from a fabric separate from the inner cup part 11*a* and the front cup part 11*b*.

The first connecting part 16*a* is the part bound from Q1 to Q4 to Q3 to Q2 to P5 to P4 to Q1 (refer to FIG. 5), and the second connecting part 16*b* is the part bound from Q5 to Q3 to Q2 to Q2' to Q3' to Q5' to Q5 (refer to FIG. 6).

The first connecting part 16*a* is connected with the inner cup part 11*a* on edge Q4 to Q3, and is connected with the wing part 13 on edge P4 to P5.

The second connecting part 16*b* is connected with the inner cup part 11*a* on edge Q5 to Q3, and is connected with the under-tape 21 on edge Q2 to Q2'. Note that the front cup part 11*b* is connected with the under-tape 21 on edge P5 to P6 to P6' to P5'.

On the side edge of the cup, the inner cup part 11*a* and a side part of the front cup part 11*b* are connected via the first connecting part 16*a*. Furthermore, on the lower edge of the cup, the lower edge (edges Q3 to Q5, Q5' to Q3') of the inner cup part 11*a* and the lower edge (edge P5 to P6 to P6' to P5') of the front cup part 11*b* are connected via the second connecting part 16*b*.

In the examples shown in FIGS. 1 to 14, though the upper edge (edge Q4 to Q5) of the inner cup part 11*a* is not connected with and is separate from the front cup part 11*b*, the inner cup part 11*a* is not limited to this configuration. The inner cup part 11*a* may not be separate from the front cup part 11*b*. When the shoulder strap 12 has an inside and outside double structure, the upper edge (edge Q4 to Q5) of the inner cup part 11*a* is preferably separate from the front cup part 11*b*.

Figure 15:
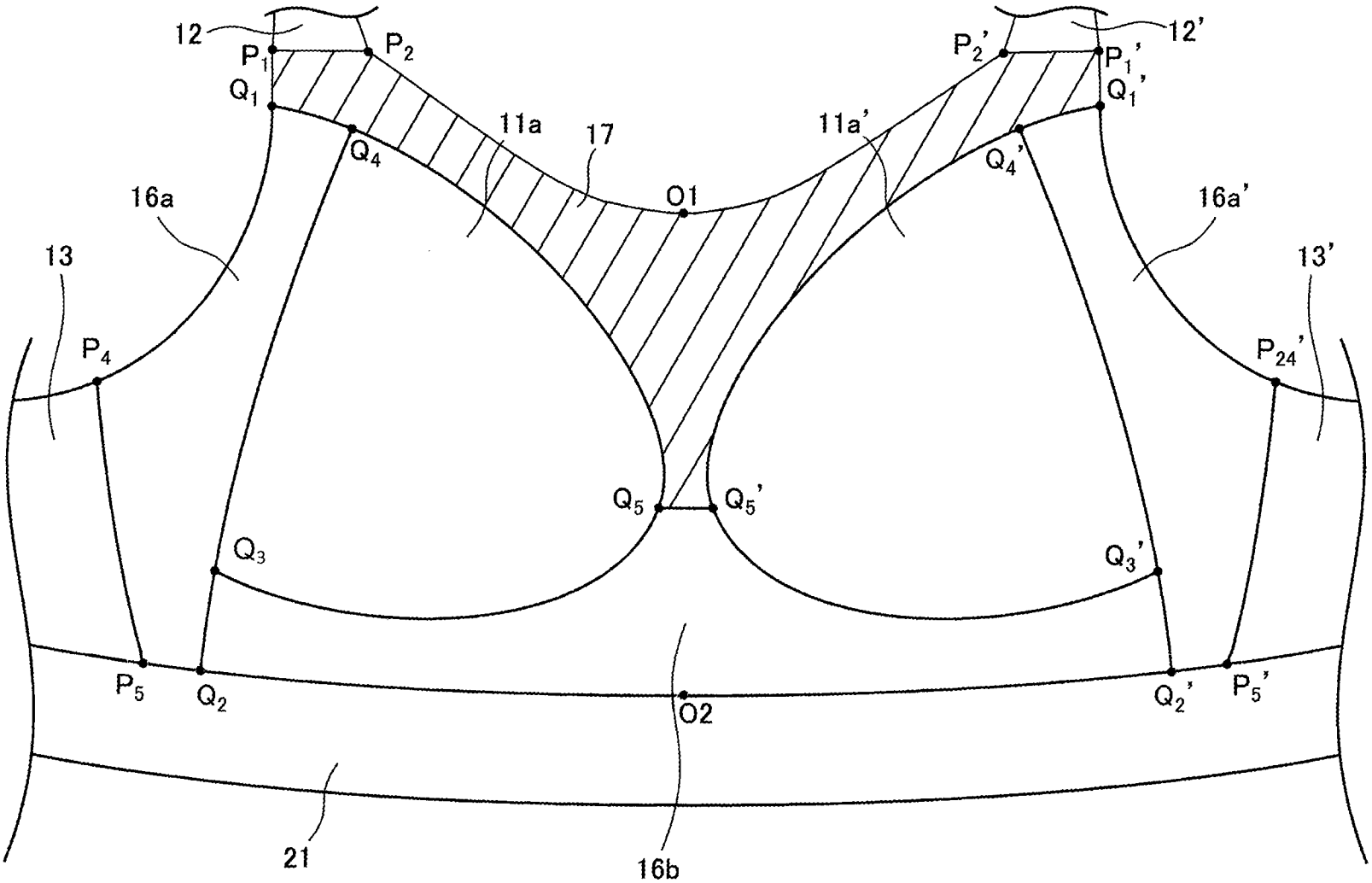
FIG. 15 is a view showing an extracted portion of the inner cup parts of the sports bra according to the present invention, and shows an example of the configuration of the reinforced part of the inner cup parts.
Figure 16:
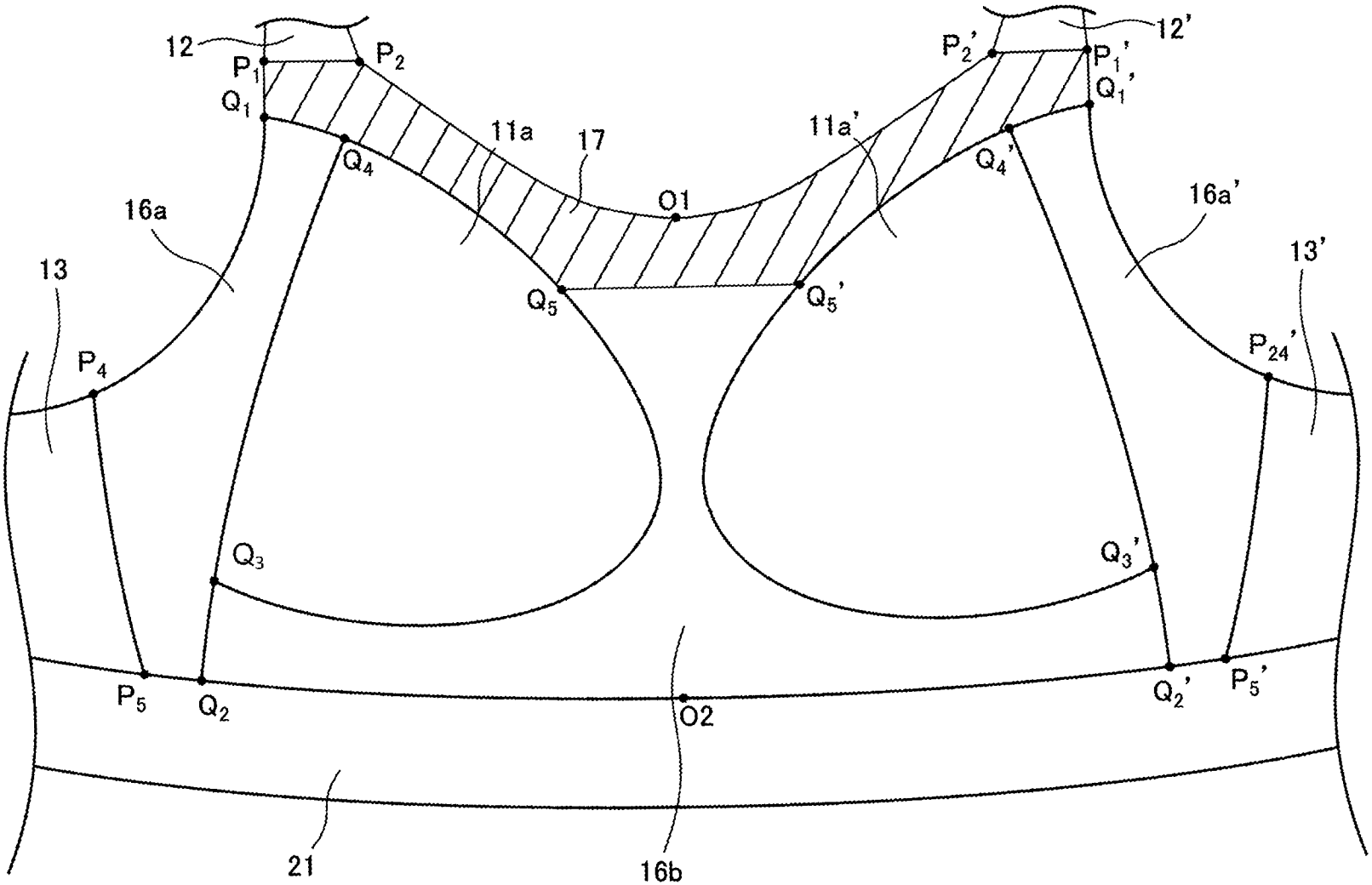
FIG. 16 is a view showing an extracted portion of the inner cup parts of the sports bra according to the present invention, and shows an example of the configuration of the reinforced part of the inner cup parts.

As an example of a structure in which the inner cup part 11*a* and the front cup part 11*b* are not separate, in the example shown in FIGS. 15 and 16, the reinforced part 17 of the inner cup part 11*a* is provided in the part bound from P2 to P1 to Q1 to Q4 to Q5 to Q5' to Q4' to Q1' to P1' to P2' to P2. The reinforced part 17 of the inner cup part 11*a* is connected with the front cup part 11*b* on edge Q1 to P1 to P2 to P2' to P1' to Q1', the first connecting part 16*a* is connected with the front cup part 11*b* on edge Q1 to P4 and edge P4 to P5, and the second connecting part 16*b* is connected with the front cup part 11*b* and the under-tape 21 on edge P5 to Q2 to Q2' to P5', and thus, the inner cup part 11*a* is connected with and is not separate from the front cup part 11*b* via the reinforced part 17 of the inner cup part 11*a*, the first connecting part 16*a*, and the second connecting part 16*b*. Note that in FIGS. 15 and 16, hatch lines have been added to the reinforced part 17.

Note that the front cup part 11*b* is preferably formed so as to connect the front center sides of the inner cup parts 11*a* with each other, and to further cover the upper edge portions of the inner cup parts 11*a*, preferably the gap between the two breasts.

By providing the front part 11 with a double structure composed of the inner cup parts 11*a* and the front cup part 11*b*, the breasts of the wearer can be contained and held in the inner cup parts 11*a*, and the breasts can be held down across a wide range, whereby movement of the inner cup parts 11*a*, the connecting part 16, and the breasts of the wearer can be reduced. As a result, movement of the breasts can be reduced even during intense exercise such as sports.

The inner cup parts 11*a* are formed from, for example, a polyester material, and a double raschel fabric may be used. The inner cup parts 11*a* have a bell-like shape that covers the left and right breasts in three dimensions. For example, the double raschel fabric may be sewn so as to have a bell-like shape.

By providing the reinforced part 17 in the front cup part 11*b* and/or a part of the inner cup parts 11*a*, the ability to hold down the breast during movement can be effectively demonstrated, and the movement of the breasts in any situation from everyday light activity to intense exercise such as sports can be further reduced. It is necessary that the ratio (S2/S1) of the elongational stress (S2) of the reinforced part to the elongational stress (S1) of the non-reinforced part of the front part be 1.2/1 to 700/1. When the reinforced part 17 is provided in the front cup part 11*b*, the ratio (S4/S3) of the elongational stress (S4) of the reinforced part to the elongational stress (S3) of the non-reinforced part of the front cup part 11*b* is preferably 2/1 to 700/1, more preferably 10/1 to 500/1, further preferably 10/1 to 300/1, and most preferably 10/1 to 200/1. When reinforced parts 17 are provided in the inner cup parts 11*a*, the ratio (S6/S5) of the elongational stress (S6) of the reinforced part to the elongational stress (S5) of the non-reinforced part of the inner cup parts is preferably 1.2/1 to 500/1, more preferably 3/1 to 300/1, further preferably 3/1 to 200/1, and most preferably 3/1 to 100/1.

In the present specification, the reinforced part 17 having a predetermined width includes the portions having the highest elongational stress, excluding the seams and the connecting parts with other members, in the inner cup parts 11*a* and/or the front cup part 11*b*, and is the portion having the same configuration (material, woven structure, and lamination state) as the portion having the highest elongational stress. The phrase "non-reinforced part" refers to portions other than the portions in which the reinforced part 17 is provided, and excludes the seams and connecting parts with other members. The elongational stress of the non-reinforced part is the value of the elongational stress of the portion of the non-reinforced part having a predetermined width which has the lowest elongational stress. The non-reinforced part may be substantially composed of a plurality of fabrics, and when the non-reinforced part is substantially composed of a plurality of fabrics, the non-reinforced part is the entirety of the overlapped fabrics.

Furthermore, the reinforced part 17 is arranged in the front cup part and/or the inner cup parts 11*a* above (the upper side of the body of the wearer, also referred to as the upper part of the front cup part 11*b* and/or the inner cup parts 11*a*) a line parallel to the lower edge of the front cup part and/or the inner cup parts passing through the midpoint (O4) of the line segment connecting the midpoint (O1) of the upper edge of the front cup part 11*b* and/or the inner cup parts 11*a* with the midpoint (O2) of the lower edge of the front cup part 11*b* and/or the inner cup parts 11*a*, and the reinforced part 17 preferably occupies at least 10% of the area of the upper part of the front cup part 11*b* and/or the inner cup parts 11*a*, and more preferably occupies 40% or more of the area, whereby the force for holding the breasts during movement can be effectively demonstrated. The area of the upper part of the front part is the area of the side of the front cup part 11*b* or the inner cup parts 11*a* on which the reinforced part 17 is provided, and when reinforced parts 17 are provided in both the front cup part 11*b* and the inner cup parts 11*a*, it is preferable that the reinforced part 17 provided in either the front cup part 11*b* or the inner cup parts 11*a* occupy an area equal to at least 10% of the area of the upper part of the front cup part 11*b* or the inner cup parts 11*a*. Furthermore, when the reinforced part 17 is provided in the front cup part 11*b*, in order to follow the shape of the inner cup parts 11*a*, it is preferable that the reinforced part 17 not be arranged in the side part of the front cup part to the greatest degree possible. The side part of the front cup is the part bound from P3 to P4 to P5 to P6 to P3 (refer to FIG. 7).

Figure 11:
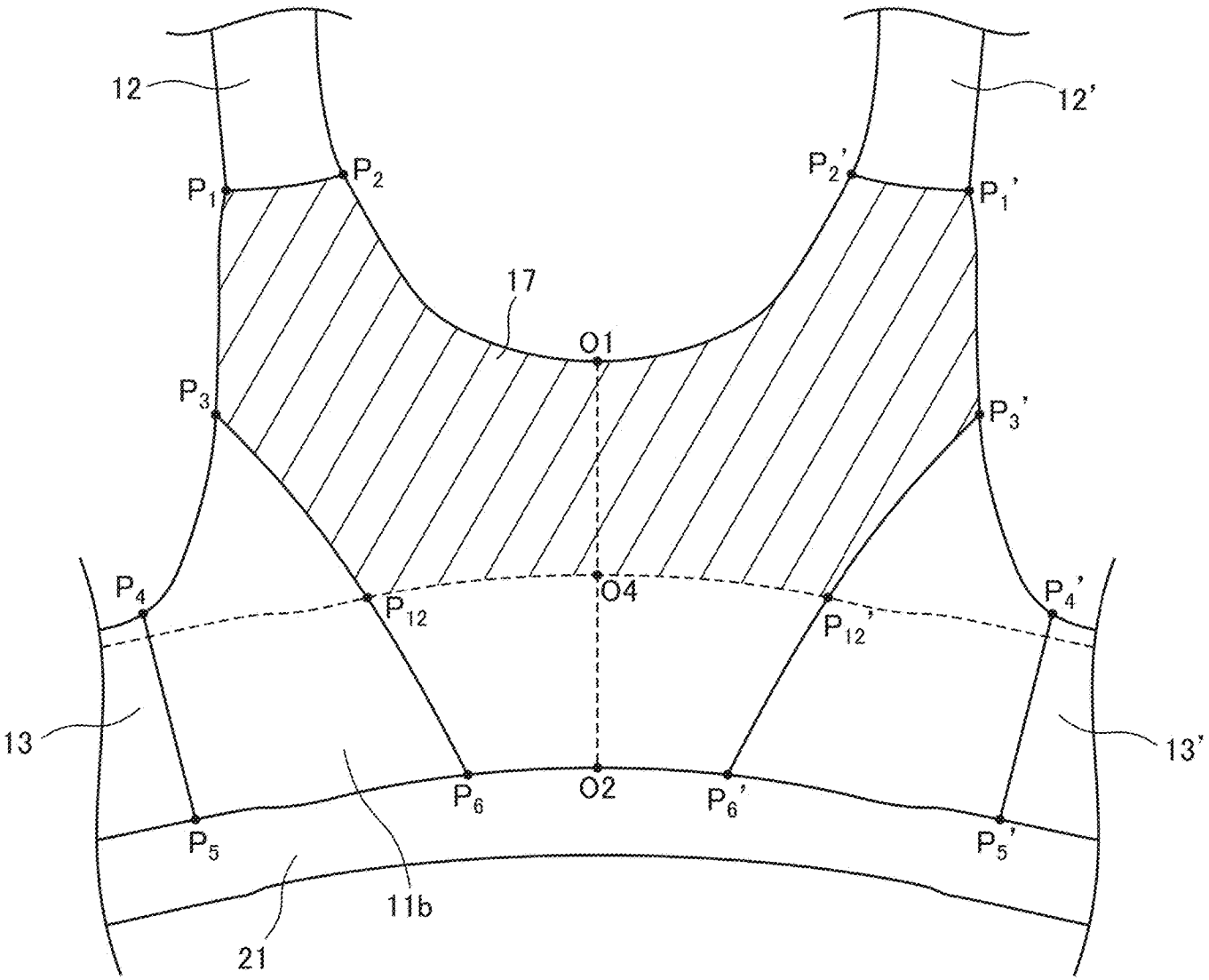
FIG. 11 is a view showing an extracted portion of the front cup part of the sports bra according to the present invention, and shows an example of the configuration of the reinforced part of the front cup part.

In the example shown in FIG. 11, which is an example in which the reinforced part 17 is provided in the front cup part 11*b*, the reinforced part 17 is provided in the part bound from P2 to P1 to P3 to P12 to O4 to P12' to P3' to P1' to P2' to P2. Furthermore, in the example shown in FIG. 12, the reinforced part 17 is provided in the part bound from P2 to P1 to P13 to P13' to P1' to P2' to P2. Note that in FIGS. 11 and 12, hatched lines have been added to the reinforced part 17.

In the examples shown in FIGS. 15 and 16, which are examples in which a reinforced part 17 is provided in the inner cup parts 11*a*, the reinforced part is provided in the part bound from P2 to P1 to Q1 to Q4 to Q5 to Q5' to Q4' to Q1' to P1' to P2' to P2. In FIGS. 15 and 16, the areas of the reinforced parts are different. Though the reinforced part 17 of the inner cup part 11*a* is a part of the inner cup part 11*a*, the reinforced part 17 may be a member separate from the inner cup part 11*a*.

By providing such a reinforced part 17 in the front cup part 11*b* and/or the inner cup parts 11*a*, the left and right breasts are supported, whereby movement of the breasts is suppressed, and the shape of the breasts can be retained.

The reinforced part 17 can be substantially composed of a plurality of fabrics.

Figure 17:
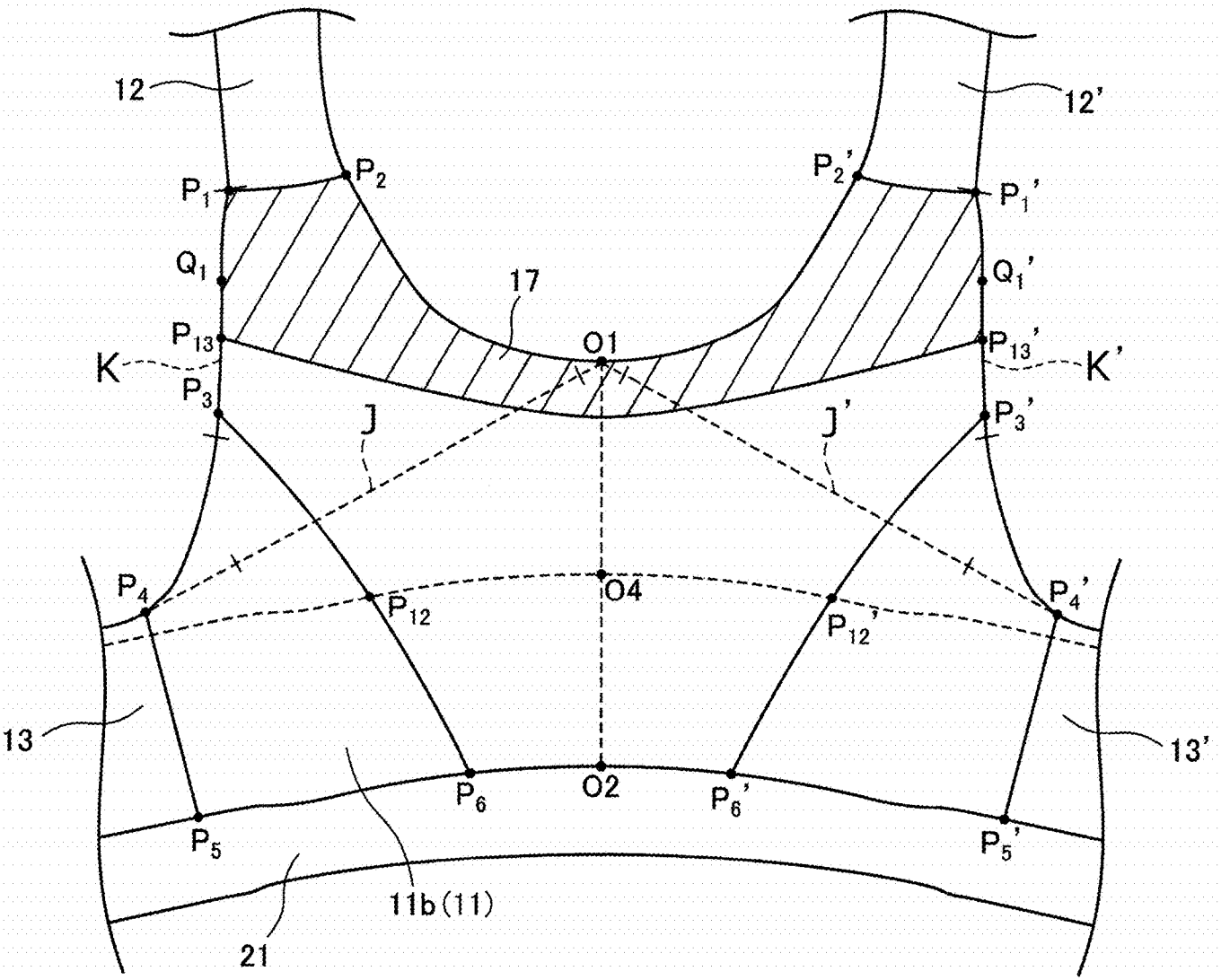
FIG. 17 is a view showing an extracted portion of the front cup part of the sports bra according to the present invention, and shows an example of the configuration of the reinforced part of the front cup part.

Furthermore, as in the example of FIG. 17, when line segments connecting the midpoint (O1) of the upper edge of the front part 11 with the upper points P4, P4' of the connection positions between the front part 11 and the left and right wing parts 13 are defined as J and J', respectively, the reinforced part 17 is preferably present in 5 to 80% of positions on line segments J, J' from the midpoint (O1) of the upper edge of the front part 11 toward the upper points (P4, P4') of the connection positions between the front part 11 and the left and right wing parts 13. The reinforced part preferably has a length of at least 5 cm in any direction, and more preferably a length of at least 7 cm. As a result, the reinforced part 17 can be arranged in an optimal position for suppressing movement of the breasts and maintaining the shape of the breasts.

In a configuration in which the upper edge (edge Q4 to Q5) of the inner cup part 11*a* is separated from the front cup part 11*b*, as shown in the example of FIG. 17, when curves connecting from the side connection positions P1, P1' between the left and right shoulder straps and the front part 11 toward the upper points P4, P4' of the connection positions between the front part 11 and the left and right wing parts 13 are defined as K and K', respectively, junctions Q1, Q1' with the front cup part 11*b* via the first connecting parts 16*a* of the inner cup parts are preferably present in 0 to 50% of positions on the line segments K, K' from the side connection positions P1, P1' between the left and right shoulder straps 12 and the front part 11 toward the upper points P4, P4' of the connection positions between the front part 11 and the left and right wing parts 13, and are more preferably present in 0 to 20% of positions. As a result, the reinforced part 17 provides leftward and rightward tension at the junctions Q1, Q1' with the front cup part 11*b* via the first connecting parts 16*a* of the inner cup parts 11*a*, whereby the fit of the bra with the body can be enhanced due to the pressing of the reinforced parts 17 toward the wearer side, and movement of the breasts can be further suppressed. As in the illustrated examples, the junctions between the front cup part 11*b* and the inner cup part 11*a* may be made via a member separate from the connecting part 16, and the elongational stresses of the connecting member is preferably higher than that of the inner cup part 11. The ratio (S14/S5) of the elongational stress (S14) of the connecting member to the elongational stress (S5) of the non-reinforced part of the inner cup part is 1/1 to 500/1, and more preferably 2/1 to 200/1.

The connecting parts 16 (first connecting part 16*a*, second connecting part 16*b*) between the front cup part 11*b* and the inner cup parts 11*a* are formed from, for example, a polyester material, and may be a textile fabric. The elongational stress of the connecting parts 16 is preferably higher than those of the inner cup parts 11*a* and the wing parts 13.

Figure 8:
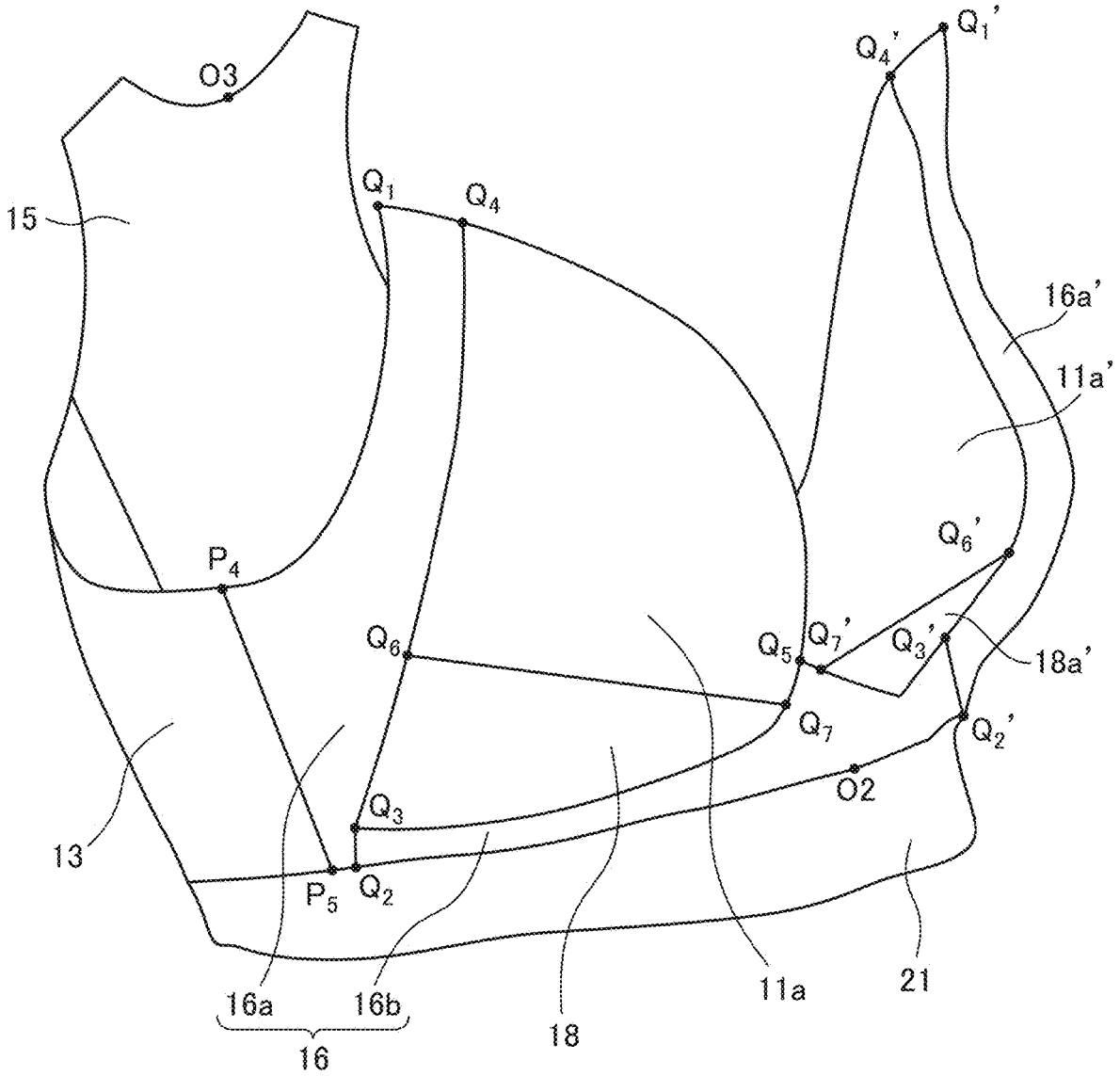
FIG. 8 is a perspective view showing an example of the structure of the sports bra according to the present invention in the case in which cup support parts are arranged in the inner cup parts.

As shown in FIG. 8, cup support parts 18 can be provided on the outside of the inner cup parts 11*a*, i.e., on the side opposite the inner cup parts 11*a*. In the example shown in FIG. 8, cup support parts 18 composed of a separate fabric are provided in the lower parts of the outside of the inner cup parts 11*a* in the parts bound from Q6 to Q3 to Q7 to Q6 and from Q6' to Q3' to Q7' to Q6'. Furthermore, in the example shown in FIG. 18, a cup support part 18 composed of a separate fabric is provided on the outside between the left and right inner cup parts 11*a*, 11*a*' in the part bound from Q6 to Q7 to Q7' to Q6' to Q6. The cup support part 18 is connected with the reinforced part 17 of the inner cup parts 11*a* on edge Q6 to Q6', and edge Q7 to Q7' is connected with the under-tape 21, the second connecting part 16*b*, and the front cup part 11*b*. However, edge Q6 to Q7 and edge Q6' to Q7' are not connected with the inner cup parts 11*a* and the second connecting part 16*b* and are separated therefrom. By not connecting edge Q6 to Q7 and edge Q6' to Q7', when worn, the form of the cup support part 18 follows the three-dimensional shape of the inner cup parts 11*a*, the gap between the left and right inner cup parts 11*a* and 11*a*' (the gap between the two breasts) can be filled, and the fit of the bra with the body is further improved. In the example shown in FIG. 18, the cup support part 18 is connected with the reinforced parts 17 of the inner cup parts on edge Q6 to Q6', though the present invention is not limited thereto. The sup support part 18 may be separated from reinforced part 17 on edge Q6 to Q6', and is only required to be connected with a part of the reinforced parts 17, the inner cup parts 11*a*, 11*a*', the shoulder straps 12, the connecting part 16, and the front cup part 11*b*, but is preferably connected with an inelastic member, such as the reinforced part 17. By providing the cup support part 18, the shape of the inner cup part 11*a* can be maintained without the pressure applied to the bust of the wearer becoming excessive, whereby the movement mitigation properties are further improved. The ratio (S7/S5) of the elongational stress (S7) of the cup support parts 18 to the elongational stress (S5) of the non-reinforced parts of the inner cup parts is 1/1 to 500/1, and is preferably 5/1 to 200/1. The cup support part 18 can be substantially constituted by, for example, a plurality of fabrics.

In the examples shown in FIGS. 1 to 4, the wing part 13 is the part bound from P4 to P5 to P8 to P9 to P4, and the wing part 13 is connected with the first connecting part 16*a* and the front cup part 11*b* on edge P4 to P5, and is connected with the rear part 15 on edge P8 to P9.

As shown in FIG. 3, the wing part 13 is provided from the first connecting part 16*a* extending to the left and right toward the back side of the wearer so as to connect the front cup part 11*b* and the inner cup parts 11*a*.

The front cup part 11*b*, the inner cup part 11*a*, and the wing part 13 form a lower edge part of the brassiere body, and are connected with the under-tape 21, which wraps around the brassiere body.

Figure 9:
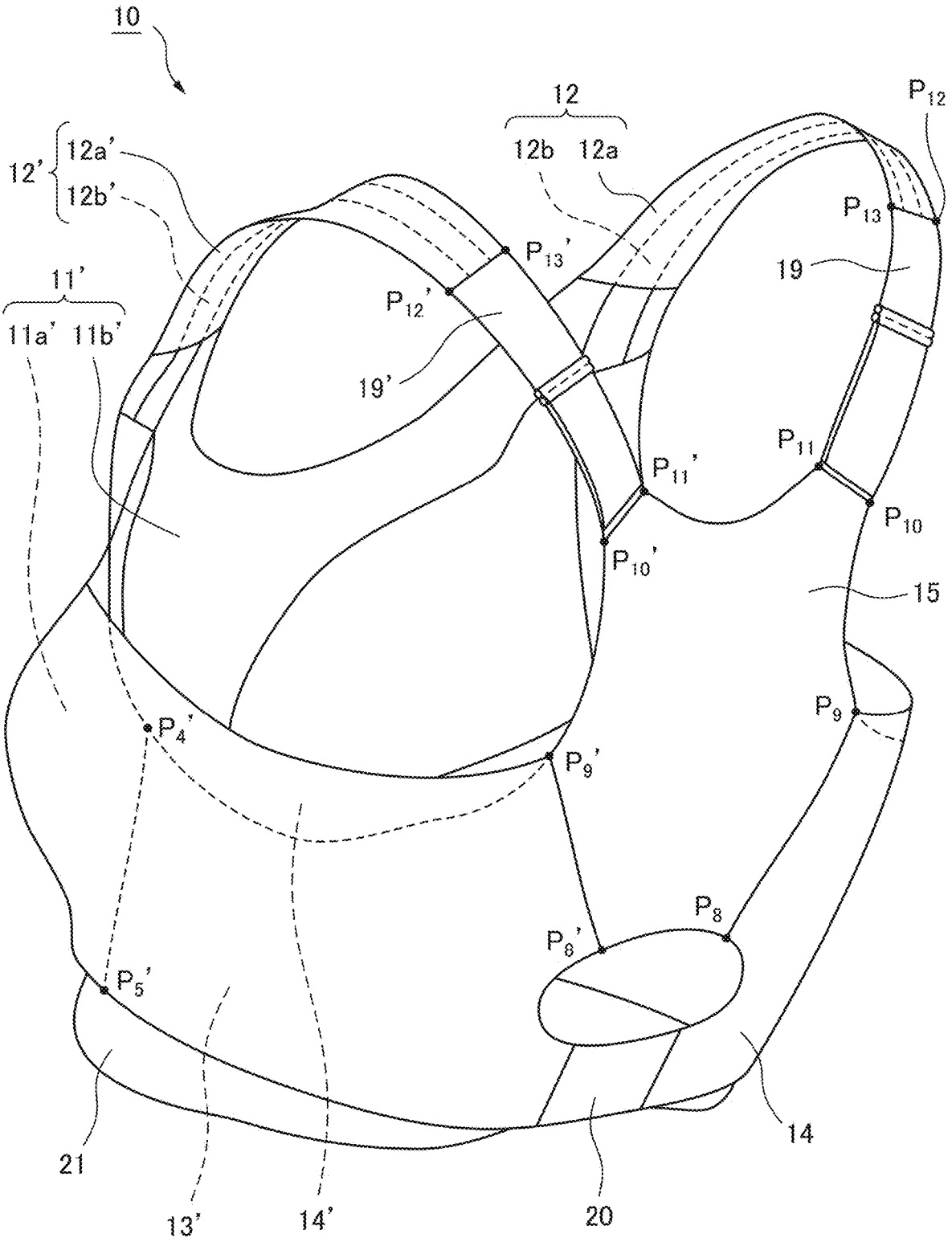
FIG. 9 is a perspective view showing an example of the structure of the sports bra according to the present invention in the case in which sub-wing parts are provided, the shoulder straps include cylindrical first strap parts and tapered second strap parts arranged inside the first strap parts, and adjusters are disposed on the straps.
Figure 10:
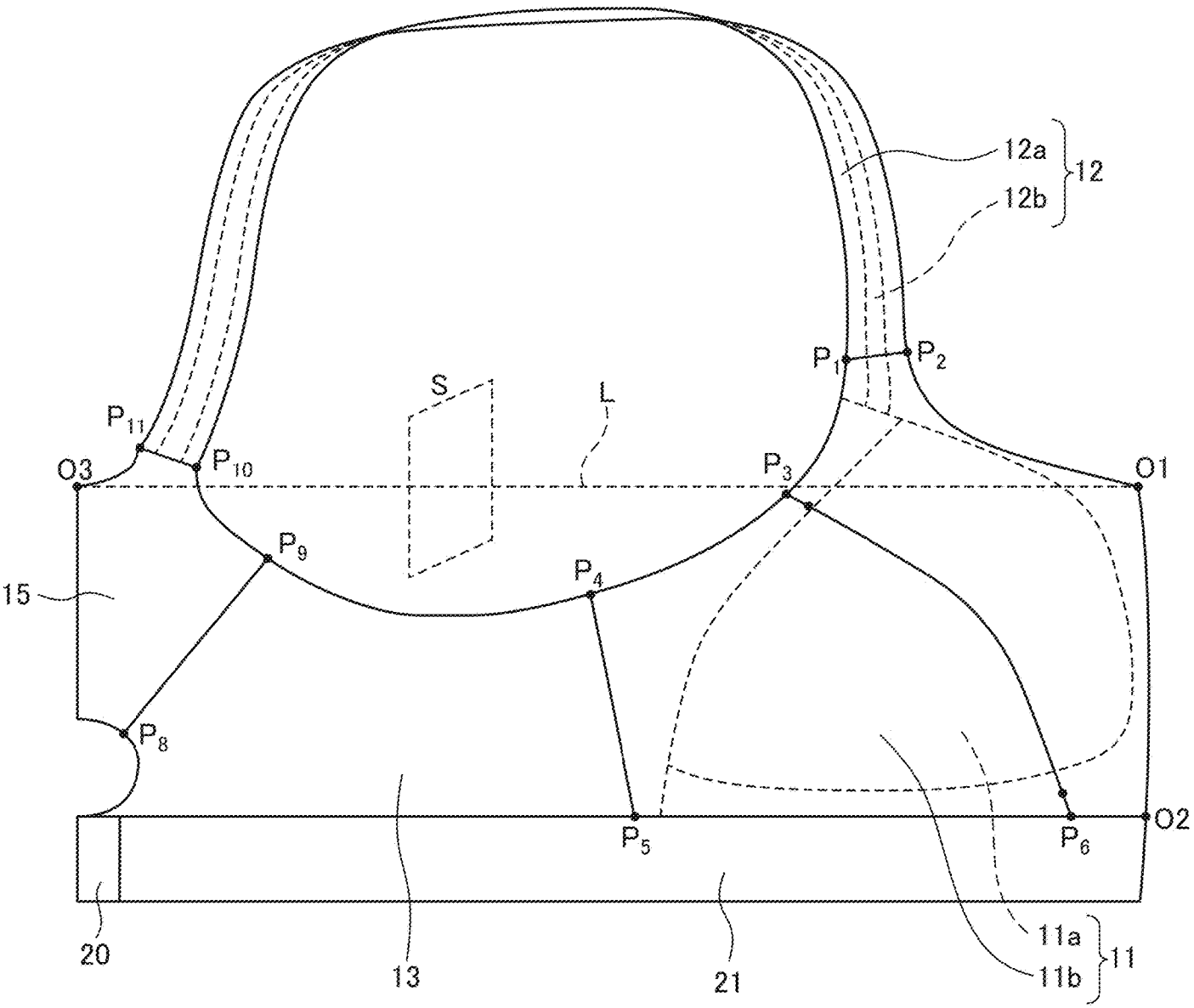
FIG. 10 is a perspective view of the sports bra according to the present invention showing an example of the configuration of the case in which the brassiere 10 is arranged so as to maximize the length of a line segment connecting the midpoint (O1) of an upper edge of the front cup part and the midpoint (O3) of an upper edge of the rear part 15.
Figure 13:
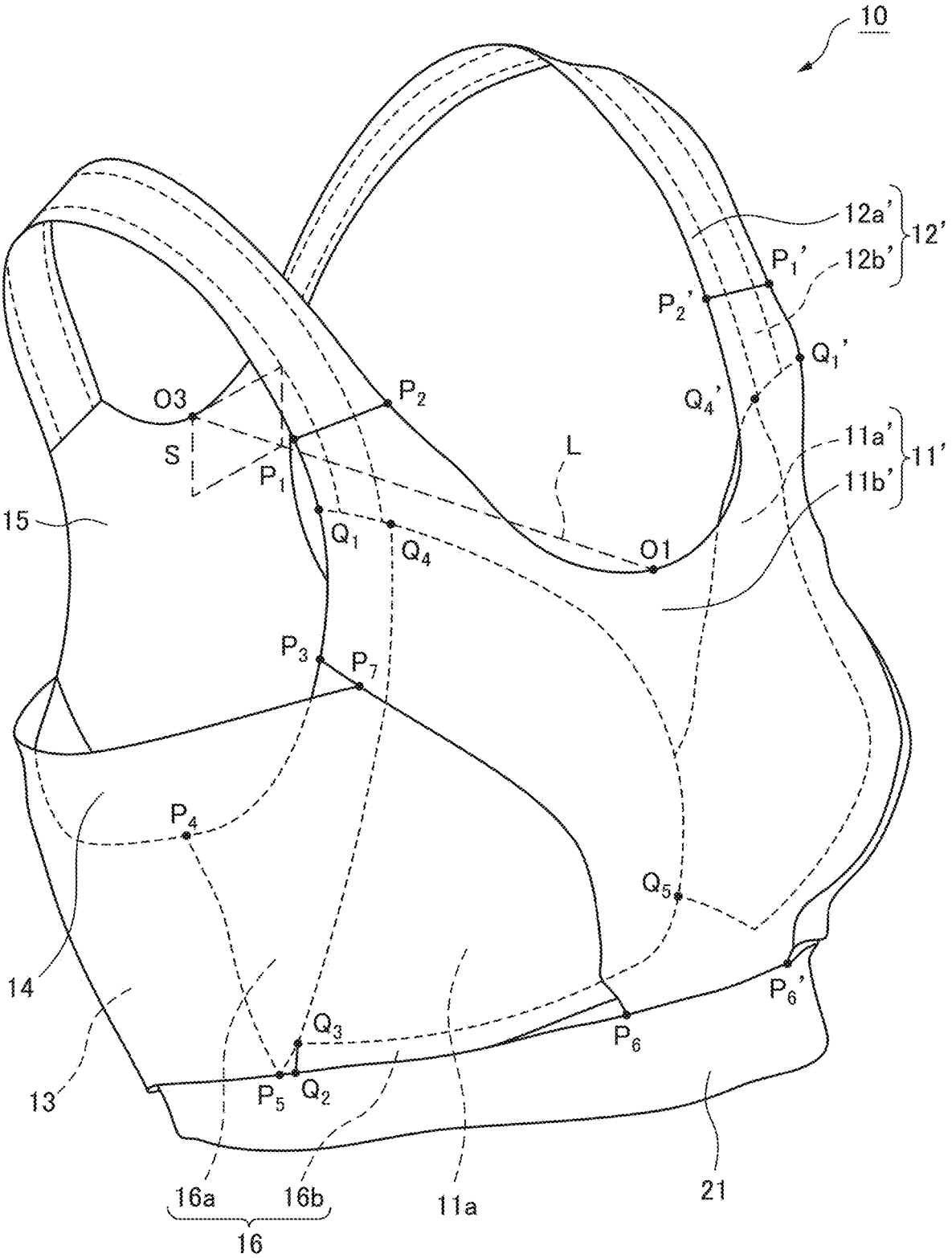
FIG. 13 is a perspective view showing an example of the front side of the sports bra according to the present invention, comprising sub-wing parts and in which the shoulder straps include cylindrical first strap parts and tapered second strap parts arranged inside the first strap parts.
Figure 14:
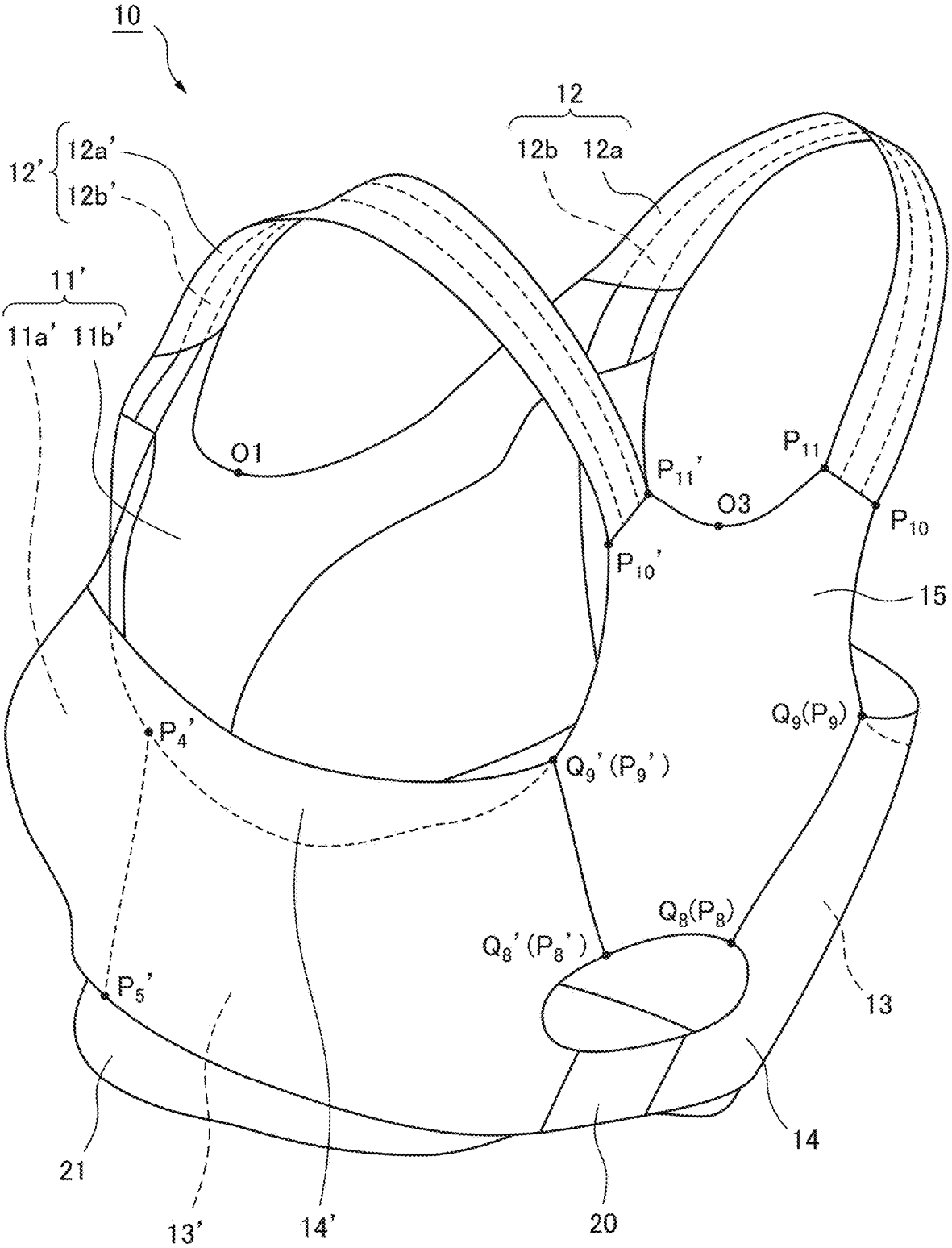
FIG. 14 is a perspective view showing an example of the configuration of the back side of the sports bra according to the present invention, comprising sub-wing parts and in which the shoulder straps include cylindrical first strap parts and tapered second strap parts arranged inside the first strap parts.

In the examples shown in FIGS. 9, 13, and 14, the sub-wing part 14 is the part bound from P7 to P6 to Q8 to Q9 to P7. The sub-wing part 14 is connected with the front cup part 11*b* on edge P7 to P6, and is connected with the rear part 15 on edge Q8 to Q9.

In the example shown in FIG. 13, the sub-wing part 14 extends from the side edge part of the front part 11 toward the back side of the wearer, and is arranged on the outside the front cup part 11, the wing part 13, and the rear part 15 in an area ranging from a part of the front cup part 11*b* to a part of the wing part 13 or a part of the rear part 15. Typically, the sub-wing part 14 can be constituted by one or a plurality of types of fabric arranged from the side edge of the front cup part 11*b* to the wing part 13. The sub-wing part 14 is not integrally formed with the main body at the cup parts 11*a*, 11*b* and the wing part 13, but is formed from an independent fabric other than the main body, and is formed over the main body.

As an embodiment of the present invention, the brassiere 10 comprises a sub-wing 14. Regarding the sub-wing 14, when the brassiere 10 is arranged so as to maximize the length of the line segment L connecting the midpoint (O1) of the upper edge of the front cup part 11*b* and/or the inner cup parts 11*a* with the midpoint (O3) of the upper edge of the connection site (e.g., the wing part 13, or the hook part 20, which connects the left and right wing parts 13 on the back side of the wearer, or the rear part 15, which connects the shoulder straps 12 and the wing parts 13 on the back side of the wearer) between the shoulder straps 12 and the wing parts 13 on the back side of the wearer (refer to FIG. 10), and a plane S having a normal in the same direction as the line segment is defined, junctions between the sub-wing part 14 and the front cup part 11*b* and/or the inner cup parts 11*a*, or the wing part 13, or the rear part 15 are present in 0 to 40% of positions on the plane from the midpoint (O1) of the upper edge of the front cup part 11*b* and/or the inner cup parts 11*a* on the line segment L toward the wing part 13, or the center of the hook part 20, or the midpoint (O3) of the upper edge of the rear part 15, and are present in 70 to 100% of positions on the plane, and the sub-wing part 14 has an area which is not connected with the wing part 13.

Note that when the brassiere does not include a rear part 15, the midpoint (O3) of the upper edge of the rear part 15 is the midpoint of the upper edge of the connection side between the shoulder strap 12 and the wing part 13 on the back side of the wearer.

It is preferable that the elongational stress of the sub-wing part 14 be higher than that of the wing part 13. Due to the sub-wing part 14, the fit of the brassiere 10 with the skin can be improved, and since a tensile force is imparted to the cup side junction of the sub-wing part 14 when worn, a greater movement mitigation effect can be demonstrated.

The ratio (S9/S8) of the elongational stress (S9) of the sub-wing part 14 to the elongational stress (S8) of the wing part 13 is 0.7/1 to 10/1, preferably 1/1 to 10/1, more preferably 1/1 to 5/1, and further preferably 2/1 to 5/1, whereby the movement mitigation properties can be improved without excessive pressure.

As a result, when worn, the front cup part 11*b* exerts an increased pressing force across a wide range of the breasts, whereby movement of the breasts during intense exercise such as sports can be reduced.

A fabric comprising an elastic interwoven spandex is preferably used for the sub-wing part 14, and the sub-wing part 14 can be constituted by a fabric which is less elastic than the fabric of the wing part or the cup parts such as a cotton fabric, a polyester knit fabric, or a knit fabric of a polyamide material.

In the examples shown in FIGS. 9, 13, and 14, the shoulder strap 12, the wing part 13, and the sub-wing part 14, are each connected with the rear part 15 on the back side of the wearer. The rear part 15 is connected with the shoulder strap 12 on edge P10 to P11, with the wing part 13 on edge P8 to P9, and with the sub-wing part 14 on edge Q8 to Q9 by means of sewing or the like.

When a rear part 15 is provided, the ratio (S13/S9) of the elongational stress (S13) of the rear part 15 to the elongational stress (S9) of the sub-wing part 14 is preferably 0.7/1 or more. As a result, the effect of the sub-wing part 14 (the effect by which the front cup part 11*b* and the sub-wing part 14 hold the inner cup parts 11*a* and the wing part 13 across a wide range) can be sufficiently demonstrated.

Furthermore, as shown in FIG. 14, the brassiere 10 may include a hook part 20 for, for example, size adjustment, on the back side of the wearer. The hook part 20 may not be connected with the rear part 15, and in, for example, the example shown in FIG. 14, the hook part 20 is continuously and integrally formed with the wing part 13 and the back side end part of the under-tape 21.

The shoulder strap 12 extends upwards from the front part 11, passes over the left or right shoulder of the wearer, and is connected with the wing part 13 or the rear part 15 on the back side of the wearer. In the present embodiment, the shoulder strap 12 preferably has a double structure. Specifically, as shown in FIG. 13, the shoulder strap 12 comprises a cylindrical first strap part 12*a* and a tapered second strap part 12*b* arranged inside the first strap part 12*a*. One end of the first strap part 12*a* is connected with the front cup part 11*b* (refer to FIG. 13). In the example shown in FIG. 13, one end of the first strap part 12*a* is connected with the front cup part 11*b* on edge P1 to P2. One end of the second strap part 12*b* is connected with the inner cup part 11*a* or the first connecting part 16*a* (refer to FIG. 13). In the example shown in FIG. 13, one end of the second strap part 12*b* is connected with the first connecting part 16 on edge Q1 to Q4. The other end of the first strap part 12*a* and the other end of the second strap part 12*b* are preferably connected more rearward than the position at which the shoulder strap 12 abuts with the shoulder, at edge P10 to P11 in the example shown in FIG. 14, by, for example, sewing, and are directly connected with the rear part 15 or are indirectly connected with the rear part 15 via an adjuster 19, which is described later.

By providing the shoulder strap 12 with an inner and outer double structure, slippage of the shoulder strap 12 due to movement during exercise or the like can be prevented. Even if the shoulder strap 12 slips or shakes, since only the inner second strap part 12*b* moves and the outer first strap part 12*a* adheres with the skin and does not substantially move, the slippage of the shoulder strap 12 described above, movement of the breasts, and rubbing of the shoulder strap 12 against the skin can be reduced.

The double structure of the shoulder strap is not limited to this structure. For example, the structure may be divided into a wearer wide and an outer side. In such a case, the first strap part is arranged on the wearer side, and the second strap part is arranged on the outside.

The elongational stress of the second strap part 12*b* is greater than that of the first strap part 12*a*. It is desirable that the ratio (S11/S10) of the elongational stress (S11) of the tapered second strap part 12*b* to the elongational stress (S10) of the cylindrical first strap part 12*a* be 1.2/1 to 30/1, and preferably 3/1 to 30/1. As a result, movement of the breasts can be reduced without excessive pressure on the shoulders.

Further, the shoulder strap 12 may include an adjuster 19 for length adjustment, as shown in, for example, FIG. 9, more rearward (on the wearer back side) than the connecting part of the first strap 12*a* and the second strap 12*b*. One end of the adjuster 19 is connected with the connecting part (P12 to P13) of the first strap part 12*a* and the second strap part 12*b*, and the other end is connected with the rear part 15 on edge P10 to P11. The ratio (S15/S11) of the elongational stress (S15) of the adjuster 19 to the elongational stress (S11) of the tapered second strap part 12*b* is preferably 0.5/1 to 30/1.

The materials of the members of the brassiere 10 of the present invention are not particularly limited, and synthetic fibers such as polyester fibers and polyamide fibers, cellulose fibers such as rayon, cupra, and acetate, and natural fibers such as cotton and hemp can suitably be used. The structure of the fabric constituting the members is also not particularly limited, and a knitted fabric, woven fabric, or non-woven fabric can be used.

Furthermore, crimped fibers may be used. In the present invention, it is useful to use a fabric having appropriate elasticity characteristics for each member. A fabric comprising an elastic interwoven spandex is preferably used for each of the members. Furthermore, double circular knit fabrics, tricot knit fabrics, or raschel knit fabrics can be used as the fabrics of the front cup part 11*b*, the wing part 13, and the rear part 15, and it is preferable that tricot half fabrics be used.

As described above, according to the brassiere of the present invention, by dividing the front part which covers the breasts into inner cup parts and a front cup part, and providing a reinforced part having a predetermined width in the front part (in at least one of the inner cup parts and the front cup part), the inner cup parts can wrap across a wide range on the wearer side when worn, and movement of the breasts in the upward and downward directions (Y-direction), the left and right directions (X-direction), and the forward and rearward directions (Z-direction) during intense exercise such as sports can be suppressed, and the retention pressure is appropriate and comfortable.

EXAMPLES

The present invention will be specifically described below by way of the Examples.

Note that in the descriptions below, though specific numerical values are described, the present invention is not limited to these examples.

The brassieres obtained in the Examples and Comparative Examples were evaluated by the following methods.

(1) Elongational Stress of Fabric of Each Member

The stress of fabric samples cut from the brassieres were measured in accordance with the cut strip method of JIS L1096.8.14.1.

Regarding the 10% elongational stress characteristics, the stress at the time of a 10% elongation in the vertical direction and the stress at the time of a 10% horizontal elongation (per 2.5 cm width) were measured, and the average value was calculated.

| | |
|---|---|
| Width of Evaluation Sample: | 2.5 cm |
| Clamping Length of Evaluation Sample: | 10 cm |
| Elongation Rate: | 30 cm/min |

Though measurement was performed under the above conditions for fabric samples cut from each member of the brassiere, when the length of the evaluation sample was insufficient for clamping, the value thereof was appropriately changed. When the width of the evaluation sample was insufficient, the width was appropriately changed, and the obtained stress value was converted into a value per 2.5 cm width.

Members composed such that a plurality of fabrics were stacked were measured in a state in which the plurality of fabrics were stacked. Furthermore, only the stress at the time of 10% elongation in the vertical direction was measured for the members of the shoulder straps 12 (12*a*, 12*b*) and the adjuster 19 and under-tape 21, and the measured values thereof were used as the elongational stress.

(2) Movement Value when Worn

Brassieres were worn by three subjects having a height of 160 cm±8 cm and a brassiere size of 32C (British size) as measured by the top bust/underbust measurement method, and thereafter the subjects ran with a limited gait at a pace of 160 steps per minute and subsequently ran normally at a pace of 140 steps per minute on a treadmill at a speed of 5.5 km/h such that one foot was separated from the ground when the opposite foot landed. The travelling motion differs between limited gait running and normal running to the extent that the movement of the body is greater during normal running as compared to limited-gait running, and as a result, breast movement is also greater. At that time, reflective spheres having a diameter of 2.0 cm were attached to the clavicle and the top part of the bust, and the reflecting spheres were photographed for 20 seconds with two high-speed cameras (125 frames/second).

The movement of the clavicle during limited-gait running was 7 to 8 cm, and during normal running was 15 to 16 cm.

The difference between the average value of the local maxima and the average value of the local minima (cm) of the difference between the movement of the top of the bust and the movement of the clavicle (cm) over an interval of 20 seconds was calculated as the index of the movement of the breasts while the brassieres were worn, and the largest value among the horizontal direction (X), vertical direction (Y) and depth direction (Z) values was taken as the movement value (cm) at the time of wearing.

The average of the results of the three subjects was calculated.

(3) Maximum Applied Pressure

The pressures applied to sensors arranged in the central part of the shoulder straps, the side parts of the wings, the under top part, the upper part of the cup, the side part of the cup, and the lower part of the cup between the wearer and the brassiere when the brassiere was worn were measured using a multipoint contact pressure gauge (AMI3037-10) manufactured by AMI Techno Co., Ltd., and the maximum values among the obtained values were used as the maximum applied pressure (Pa).

(4) Comfort and Aesthetic

Comfort

The brassieres were evaluated according to the following evaluation scores during the test of (2) above, and the evaluation scores of the monitors were averaged.

5: Very comfortable with little pressure
4: Comfortable with some pressure
3: Not uncomfortable but some degree of pressure
2: Uncomfortable with noticeable pressure
1: Very uncomfortable with significant pressure Aesthetic The brassieres were evaluated according to the following evaluation scores during the test of (2) above, and the evaluation scores of the monitors were averaged.

5: Excellent appearance of breasts when brassiere is worn
4: Good appearance of breasts when brassier is worn
3: Cannot say either way
2: Unfavorable appearance of breasts when brassiere is worn
1: Poor appearance of breasts when brassiere is worn Example 1

A brassiere having a British size 32C (corresponding to a Japanese size C70) and having the form shown in FIG. 9 was produced by the following method.

In this brassiere, the difference between the top bust dimensions and the under bust dimensions was 10 cm, and the length of line segment L (refer to FIG. 10), when the brassiere was arranged so as to maximize the length of the line segment L connecting the midpoint (O1) of the upper edge of the front cup part 11*b* with the midpoint (O3) of the upper edge of the rear part 15, was 33.0 cm.

The connecting parts between the front cup part and the inner cup parts were formed from a polyester material in the form of a textile fabric, and the vertical/horizontal average elongational stress thereof was 16.3 N.

The elongational stress of the reinforced part of the front cup part was 16.7 N, the elongational stress of the non-reinforced part was 0.17 N, and the ratio (S4/S3) of the elongational stress of the reinforced part to the elongational stress of the non-reinforced part of the front cup part was 98.2/1. Note that S4/S3 corresponds to the ratio (S2/S1) of the elongational stress of the reinforced part of the front part to the elongational stress of the non-reinforced part of the front part. Furthermore, the arrangement of the reinforced part of the front cup part was the same as shown in FIG. 11, the area of the upper part of the front cup part was 296 $cm^2$, the area of the reinforced part was 237 $cm^2$, and the reinforced part of the front cup part was arranged so as to occupy 80% of the area of the upper part of the front cup part.

The sub-wing parts 14 were formed such that when the brassiere was arranged so as to maximize the length of the line segment L connecting the midpoint (O1) of the upper edge of the front cup part 11*b* with the midpoint (O3) of the upper edge of the rear part, and a plane S having a normal in the same direction as the line segment is defined, junctions were present in 9 to 34% of positions (within the front cup part) on the line segment L from the midpoint (O1) of the upper edge of the front cup part 11*b* toward the midpoint (O3) of the upper edge of the rear part 15, and in 78 to 91% of positions (positions overlapping the boundary between the rear part and the hood part with the wing parts).

In the brassiere of the present Example, regarding the plane S described above, there was a boundary between the front part 11 and the wing part 13 on the plane in 42 to 57% of positions from the midpoint (O1) of the upper edge of the front cup part 11*b* toward the midpoint (O3) of the upper edge of the rear part 15.

The elongational stress of the sub-wing parts 14 was 0.39 N, the elongational stress of the rear part 15 was 0.34 N, the elongational stress of the wing parts 13 was 0.17 N, the ratio (S13/S9) of the elongational stress of the rear part to the elongational stress of the sub-wing parts was 0.87/1, and the ratio (S9/S8) of the elongational stress of the sub-wing parts 14 to the elongational stress of the wing parts 13 was 2.3/1.

The elongational stress of the tapered second strap part 12*b* was 3.2 N, and the elongational stress of the cylindrical first strap part 12*a* was 0.17N. The ratio (S11/S10) of the elongational stress of the second strap part 12*b* to the elongational stress of the first strap part 12*b* was 18.8/1.

Furthermore, an adjuster 19 which is made of an elastic rubber was arranged as shown in FIG. 9, and the elongational stress of the adjuster 19 was 4.1 N. The ratio (S15/S11) of the elongational stress of the adjuster 19 to the elongational stress of the second strap part 12*b* was 1.3/1.

The elongational stress of the cup support parts 18 (refer to FIG. 8) provided on the outside of the inner cup parts 11*a* was 32.2 N, and the elongational stress of the inner cups was 5.4 N. The ratio (S7/S5) of the elongational stress of the cup support part 18 to the elongational stress of the inner cups was 6.0/1.

The breast movement mitigation effect during activity when the produced brassiere was worn was significant, and the maximum value of the applied pressure was small, whereby the comfort was excellent.

Example 2

A brassiere was produced in the same manner as Example 1 except that the sub-wing parts 14 of Example 1 were not provided, and thereafter the wearing tests were conducted.

Example 3

A brassiere was produced in the same manner as Example 1 except that a single fabric having an elongational stress of 3.2 N was used as the shoulder straps 12 of Example 1, and thereafter the wearing tests were conducted.

Example 4

A brassiere was produced in the same manner as Example 1 except that the sub-wing parts 14 of Example 1 were not provided and a single fabric having an elongational stress of 3.2 N was used as the shoulder straps 12, and thereafter the wearing tests were conducted.

Example 5

A brassiere was produced in the same manner as Example 1 except that a fabric having an elongational stress of 0.17 N was used as the rear part of Example 1, the elongational stress of the wing parts 13 was 0.34 N, a single fabric having an elongational stress of 3.2 N was used as the shoulder straps 12, the ratio (S9/S8) of the elongational stress of the sub-wing parts 14 to the elongational stress of the wing parts was 1.14/1, and the ratio (S13/S9) of the elongational stress of the rear part to the elongational stress of the sub-wing parts was 0.44/1, and thereafter the wearing tests were conducted.

Example 6

A brassiere was produced in the same manner as Example 1 except that when the brassiere was arranged so as to maximize the line segment L connecting the midpoint (O1) of the upper edge of the front cup part 11*b* and the midpoint (O3) of the upper edge of the rear part 15, and a plane having a normal in the same direction as the line segment is defined, the junctions of the sub-wing parts 14 of Example 1 included junctions between the sub-wing parts 14 and the front cup part 11*b* in 42 to 50% of positions on the plane from the midpoint (O1) of the upper edge of the front cup part 11*b* on the line segment L toward the midpoint (O3) of the upper edge of the rear part 15, included junctions between the sub-wing parts 14 and the rear part 15 in 60 to 65% of positions on the plane, and a single fabric having an elongational stress of 3.2 N was used as the shoulder straps 12, and thereafter the wearing tests were conducted.

Example 7

A brassiere was produced in the same manner as Example 1 except that the sub-wing parts 14 of Example 1 were not provided, a single fabric having an elongational stress of 3.2 N was used as the shoulder straps 12, and cup support parts 18 were not provided on the outside of the inner cup parts 11*a*, and thereafter the wearing tests were conducted.

Example 8

Figure 12:
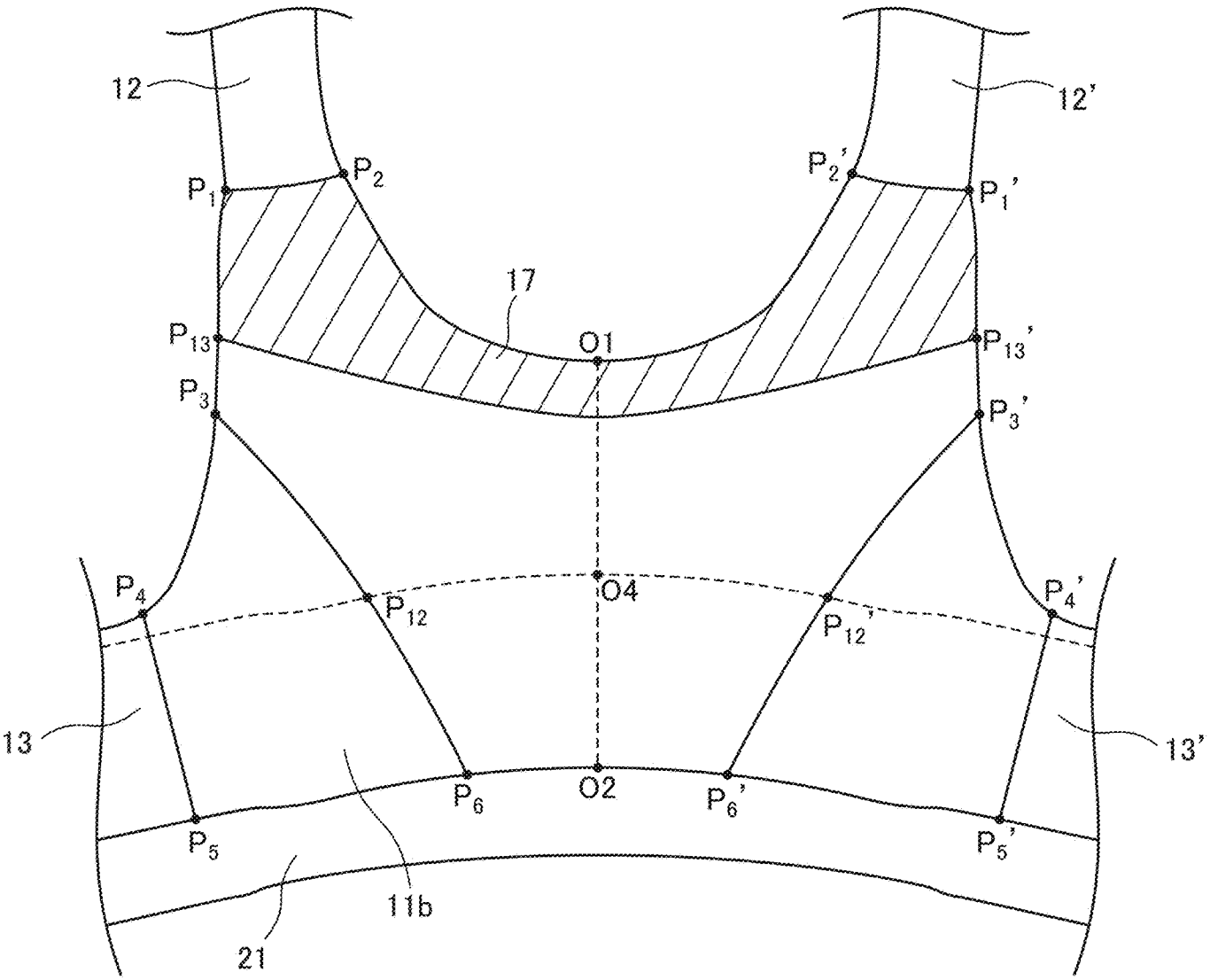
FIG. 12 is a view showing an extracted portion of the front cup part of the sports bra according to the present invention, and shows an example of the configuration of the reinforced part of the front cup part.

A brassiere was produced in the same manner as Example 1 except that the sub-wing parts 14 of Example 1 were not provided, a single fabric having an elongational stress of 3.2 N was used as the shoulder straps 12, the area of the reinforced part of the front cup part was 119 $cm^2$, the arrangement of the reinforced part of the front cup part was as shown in FIG. 12, and the reinforced part of the front cup part was arranged so as to occupy 40% of the area of the upper part of the front cup part, and thereafter the wearing tests were conducted.

Example 9

A brassiere was produced in the same manner as Example 1 except that the sub-wing parts 14 of Example 1 were not provided, a single fabric having an elongational stress of 3.2 N was used as the shoulder straps 12, the area of the reinforced part of the front cup part was 88.8 $cm^2$, the arrangement of the reinforced part of the front cup part was as shown in FIG. 12, and the reinforced part of the front cup part was arranged so as to occupy 30% of the area of the upper part of the front cup part, and thereafter the wearing tests were conducted.

Example 10

A brassiere was produced in the same manner as Example 1 except that the sub-wing parts 14 of Example 1 were not provided, a single fabric having an elongational stress of 3.2 N was used as the shoulder straps 12, the elongational stress of the cup support parts 18 provided on the outside of the inner cup parts 11*a* was 10.7 N, and the ratio (S7/S5) of the elongational stress of the cup support parts 18 to the elongational stress of the inner cups was 2.0/1, and thereafter the wearing tests were conducted.

Example 11

A brassiere was produced in the same manner as Example 1 except that the sub-wing parts 14 of Example 1 were not provided, a single fabric having an elongational stress of 3.2

N was used as the shoulder straps 12, the elongational stress of the inner cups was 0.34 N, and the ratio (S7/S5) of the elongational stress of the cup support parts 18 to the elongational stress of the inner cups was 94.7/1, and thereafter the wearing tests were conducted.

Example 12

A brassiere was produced in the same manner as Example 1 except that the sub-wing parts 14 of Example 1 were not provided, a single fabric having an elongational stress of 3.2 N was used as the shoulder straps 12, the elongational stress of the reinforced part 17 of the front cup part was 1.7 N, and the ratio (S4/S3) of the elongational stress of the reinforced part 17 to the elongational stress of the non-reinforced part was 10/1, and thereafter the wearing tests were conducted. Note that S4/S3 corresponds to the ratio (S2/S1) of the elongational stress of the reinforced part of the front part to the elongational stress of the non-reinforced part of the front part.

Example 13

A brassiere was produced in the same manner as Example 1 except that the sub-wing parts 14 of Example 1 were not provided, a single fabric having an elongational stress of 3.2 N was used as the shoulder straps 12, the elongational stress of the reinforced part 17 of the front cup part was 81.2 N, and the ratio (S4/S3) of the elongational stress of the reinforced part 17 to the elongational stress of the non-reinforced part was 478/1, and thereafter the wearing tests were conducted. Note that S4/S3 corresponds to the ratio (S2/S1) of the elongational stress of the reinforced part of the front part to the elongational stress of the non-reinforced part of the front part.

Example 14

A brassiere was produced in the same manner as Example 1 except that the elongational stress of the tapered second strap parts 12*b* of Example 1 was 0.34 N, the ratio (S11/S10) of the elongational stress of the second strap part 12*b* to the elongational stress of the first strap part 12*a* was 2.0/1, and the ratio (S15/S11) of the elongational stress of the adjuster 19 to the elongational stress of the second strap part 12*b* was 12.8/1, and thereafter the wearing tests were conducted.

Example 15

A brassiere was produced in the same manner as Example 1 except that the elongational stress of the adjuster 19 of Example 1 was 1.3 N, and the ratio (S15/S11) of the elongational stress of the adjuster 19 to the elongational stress of the second strap part 12*b* was 0.4/1, and thereafter the wearing tests were conducted.

Example 16

A brassiere was produced in the same manner as Example 1 except that a single fabric having an elongational stress of 0.17 N was used as the front cup part 11*b* of Example 1, a reinforced part 17 was not provided in the front cup part 11*b*, reinforced parts identical to those shown in FIG. 15 were provided in the inner cup parts 11*a*, the area of the upper part of the inner cup parts was 316.0 $cm^2$, the area of the reinforced part was 94.8 $cm^2$, the reinforced parts of the inner cup parts were arranged so as to occupy 30% of the areas of the upper parts of the inner cup parts, the elongational stress of the reinforced parts 17 of the inner cup parts was 16.7 N, the elongational stress of the non-reinforced parts of the inner cup parts was 5.4 N, the ratio (S6/S5) of the elongational stress of the reinforced parts 17 to the elongational stress of the non-reinforced parts of the inner cup parts was 3.1/1, and a single fabric having an elongational stress of 3.2 N was used as the shoulder straps 12, and thereafter the wearing tests were conducted. Note that S6/S5 corresponds to the ratio (S2/S1) of the elongational stress of the reinforced part of the front part to the elongational stress of the non-reinforced part of the front part.

Example 17

Figure 18:
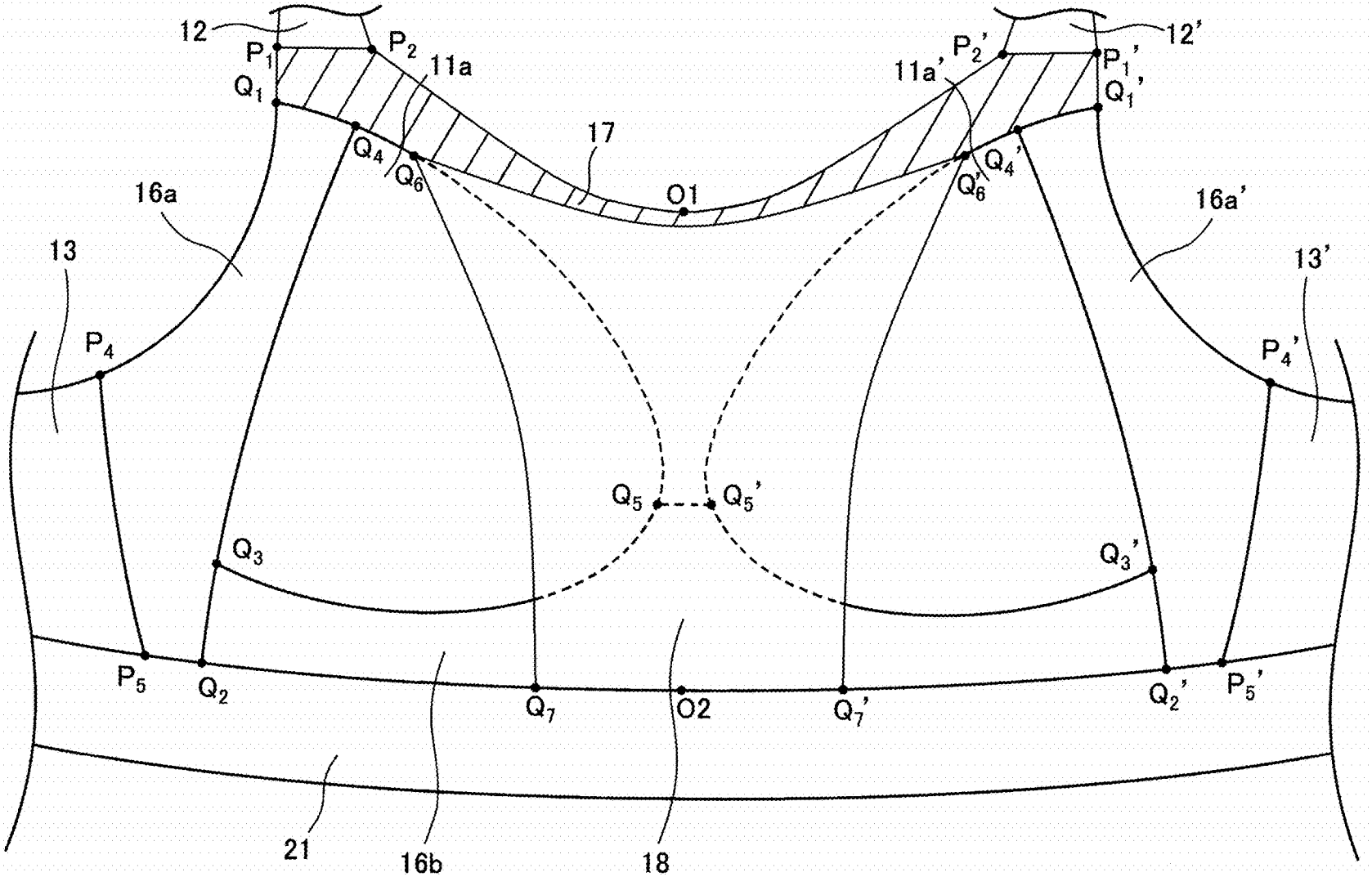
FIG. 18 is a view showing an extracted portion of the inner cup parts of the sports bra according to the present invention, and shows an example of a configuration in which a cup support part is arranged in the inner cup parts.

A brassiere was produced in the same manner as Example 16 except that reinforced parts identical to those shown in FIG. 16 were used as the reinforced parts 17 of the inner cup parts of Example 16, the area of the reinforced parts was 63.2 $cm^2$, the reinforced parts of the inner cup parts were arranged so as to occupy 20% of the areas of the upper parts of the inner cup parts, the cup support parts 18 provided on the outside of the inner cup parts 11*a* were arranged in the same manner as shown in FIG. 18, and sub-wing parts 14 were not provided, and thereafter, the wearing tests were conducted.

Example 18

A brassiere was produced in the same manner as Example 16 except that the cup support parts 18 provided on the outside of the inner cup parts 11*a* of Example 16 were not provided, and thereafter the wearing tests were conducted.

Example 19

A brassiere was produced in the same manner as Example 18 except that the elongational stress of the reinforced part 17 of the inner cup parts of Example 18 was 7.7 N, the ratio (S6/S5) of the elongational stress of the reinforced part to the elongational stress of the non-reinforced parts of the inner cup parts was 1.4/1, and sub-wing parts 14 were not provided, and thereafter the wearing tests were conducted.

Example 20

A brassiere was produced in the same manner as Example 19 except that the cup support part provided on the outside of the inner cup parts 11*a* of Example 19 was arranged in the same manner as shown in FIG. 18, the elongational stress of the cup support parts was 7.7 N, and the ratio (S7/S5) of the elongational stress of the cup support parts 18 to the elongational stress of the inner cups was 1.4/1, and thereafter the wearing tests were conducted.

Example 21

A brassiere was produced in the same manner as Example 7 except that when line segments connecting the connection positions between the left and right shoulder straps and the front part with the upper points of the connection positions of the front part with the left and right wing parts are defined as K and K', respectively, junctions between the front cup part and the inner cup parts were present in 60% of positions on line segments K and K' from the connection positions between the left and right shoulder straps and the front part toward the upper points of the connection positions of the left and right shoulder straps with the front part, and an adjuster 19 was not provided, and thereafter the wearing tests were conducted.

Example 22

A brassiere was produced in the same manner as Example 7 except that when line segments connecting the midpoint (O1) of the upper edge of the front part with the upper points P4 and P4' of the connection positions between the front part and the left and right wing parts are defined as J and J', the reinforced part 17 of Example 7 was present in 90 to 100% of positions on line segments J, J' from the midpoint (O1) of the upper edge of the front part toward the upper points (P4, P4') of the connection positions of the front part with the left and right wing parts, the area of the reinforced part was 18.0 $cm^2$, the reinforced part of the front cup part was arranged so as to occupy 6% of the upper part of the front cup part, and an adjuster 19 was not provided, and thereafter the wearing tests were conducted.

Example 23

A brassiere was produced in the same manner as Example 1 except that a reinforced part identical to that shown in FIG. 15 was provided in the inner cup parts 11*a* of Example 1, the area of the upper part of the inner cup parts was 316.0 $cm^2$, the area of the reinforced parts was 94.8 $cm^2$, the reinforced parts of the inner cup parts were arranged so as to occupy 30% of the area of the upper part of the inner cup parts, the elongational stress of the reinforced parts of the inner cup parts was 16.7 N, the elongational stress of the non-reinforced parts of the inner cup parts was 5.4 N, and the ratio (S6/S5) of the elongational stress of the reinforced parts 17 to the elongational stress of the non-reinforced parts of the inner cup parts was 3.1/1, a single fabric having an elongational stress of 3.2 N was used as the shoulder straps 12, the cup support parts 18 provided outside the inner cup parts 11*a* were arranged in the same manner as shown in FIG. 18, and sub-wing parts 14 were not provided, and thereafter the wearing tests were conducted.

Example 24

A brassiere was produced in the same manner as Example 19 except that the elongational stress of the reinforced part 17 of the inner cup parts of Example 19 was 81.2 N, the elongational stress of the non-reinforced parts of the inner cup parts was 0.17 N, and the ratio (S6/S5) of the elongational stress of the reinforced part 17 to the elongational stress of the non-reinforced parts of the inner cup parts was 478/1, and thereafter the wearing tests were conducted. Note that S6/S5 corresponds to the ratio (S2/S1) of the elongational stress of the reinforced part of the front part to the elongational stress of the non-reinforced part of the front part.

Comparative Example 1

A brassiere was produced in the same manner as Example 1 except that the inner cup parts 11*a*, the cup support part 18, the connecting parts 16, and the sub-wing parts 14 were not included, and in the shoulder straps 12, the tapered second strap parts 12*b*, which were arranged inside the first strap parts 12*a*, were connected with the first strap parts 12*a* and the front cup part 11*b* on edge P1 to P2, and thereafter the wearing tests were conducted.

Comparative Example 2

A brassiere was produced in the same manner as Example 1 except that a single fabric having an elongational stress of 0.17 N was used as the front cup part 11*b* of Example 1, a reinforced part 17 was not provided in the front cup part 11*b*, and sub-wing parts 14 were not provided, and thereafter, the wearing tests were conducted.

Comparative Example 3

A brassiere was produced in the same manner as Example 1 except that a single fabric having an elongational stress of 0.17 N was used as the front cup part 11*b* of Example 1, a reinforced part 17 was not provided in the front cup part 11*b*, and a cup support part 18 was not provided, and thereafter the wearing tests were conducted.

Comparative Example 4

The wearing tests were conducted using a brassiere corresponding to the brassiere described in Patent Literature 1.

Regarding the brassieres of the Examples and Comparative Examples produced as described above, the production conditions are shown in Table 1, and the evaluation results of the wearing tests are summarized in Table 2.

TABLE 1

| | Inner Cup Parts and Front Cup Parts Included in Front Part | Front Cup Part Reinforced Part | Inner Cup Part Reinforced Part | Elongational Stress Ratio of Reinforced Part to Non-Reinforced Part of Front Cup Part S4/S3 (S2/S1) | Ratio of Elongational Stress of Reinforced Part to Non-Reinforced Part of Inner Cup Parts S6/S5 (S2/S1) | Arrangement of Reinforced Part of Front Cup Part | Arrangement of Reinforced Part of Inner Cup Parts | Proportion of Upper Part of Front Cup Part Occupied by Reinforced Part |
|---|---|---|---|---|---|---|---|---|
| Ex 1 | Present | Present | Absent | 98.2 | — | FIG. 11 | — | 80% |
| Ex 2 | Present | Present | Absent | 98.2 | — | FIG. 11 | — | 80% |
| Ex 3 | Present | Present | Absent | 98.2 | — | FIG. 11 | — | 80% |
| Ex 4 | Present | Present | Absent | 98.2 | — | FIG. 11 | — | 80% |
| Ex 5 | Present | Present | Absent | 98.2 | — | FIG. 11 | — | 80% |
| Ex 6 | Present | Present | Absent | 98.2 | — | FIG. 11 | — | 80% |
| Ex 7 | Present | Present | Absent | 98.2 | — | FIG. 11 | — | 80% |
| Ex 8 | Present | Present | Absent | 98.2 | — | FIG. 12 | — | 40% |
| Ex 9 | Present | Present | Absent | 98.2 | — | FIG. 12 | — | 30% |
| Ex 10 | Present | Present | Absent | 98.2 | — | FIG. 11 | — | 80% |

TABLE 1-continued

| | | | | | | | | |
|---|---|---|---|---|---|---|---|---|
| Ex 11 | Present | Present | Absent | 98.2 | — | FIG. 11 | — | 80% |
| Ex 12 | Present | Present | Absent | 10 | — | FIG. 11 | — | 80% |
| Ex 13 | Present | Present | Absent | 478 | — | FIG. 11 | — | 80% |
| Ex 14 | Present | Present | Absent | 98.2 | — | FIG. 11 | — | 80% |
| Ex 15 | Present | Present | Absent | 98.2 | — | FIG. 11 | — | 80% |
| Ex 16 | Present | Absent | Present | — | 3.1 | — | FIG. 15 | — |
| Ex 17 | Present | Absent | Present | — | 3.1 | — | FIG. 16 | — |
| Ex 18 | Present | Absent | Present | — | 3.1 | — | FIG. 15 | — |
| Ex 19 | Present | Absent | Present | — | 1.4 | — | FIG. 15 | — |
| Ex 20 | Present | Absent | Present | — | 1.4 | — | FIG. 15 | — |
| Ex 21 | Present | Present | Absent | 98.2 | — | FIG. 11 | — | 80% |
| Ex 22 | Present | Present | Absent | 98.2 | — | Side | — | 6% |
| Ex 23 | Present | Present | Present | 98.2 | 3.1 | FIG. 11 | FIG. 16 | 80% |
| Ex 24 | Present | Absent | Present | — | 478 | — | FIG. 15 | — |
| Comp Ex 1 | Absent | | Present | 98.2 | — | FIG. 11 | — | 80% |
| Comp Ex 2 | Present | Absent | Absent | — | — | — | — | — |
| Comp Ex 3 | Present | Absent | Absent | — | — | — | — | — |
| Comp Ex 4 | — | — | — | — | — | — | — | — |

| | Proportion of Upper Part of Inner Cup Parts Occupied by Reinforced Part | Position of Reinforced Part (Distance on Line Segments J, J' from Midpoint of Upper Edge of Front Part) (%) | Distance of Side Junction Between Front Cup Part and Inner Cup Parts from Shoulder Strap (%) | Cup Support Part on Front Side of Inner Cup Parts | Ratio of Elongational stress of Cup Support Part to Non-Reinforced Part of Inner Cup PartsS7/S5 | Sub-Wing Parts | Ratio of Elongational stress of Sub-Wing Parts to Wing PartsS9/S8 | Ratio of Elongational stress of Rear Part to Sub-Wing PartsS13/S9 |
|---|---|---|---|---|---|---|---|---|
| Ex 1 | — | 0~64 | 10 | Present/ FIG. 8 | 6.0 | Present | 2.3/1 | 0.87/1 |
| Ex 2 | — | 0~64 | 10 | Present/ FIG. 8 | 6.0 | Absent | — | — |
| Ex 3 | — | 0~64 | 10 | Present/ FIG. 8 | 6.0 | Present | 2.3/1 | 0.87/1 |
| Ex 4 | — | 0~64 | 10 | Present/ FIG. 8 | 6.0 | Absent | — | — |
| Ex 5 | — | 0~64 | 10 | Present/ FIG. 8 | 6.0 | Present | 1.14/1 | 0.44/1 |
| Ex 6 | — | 0~64 | 10 | Present/ FIG. 8 | 6.0 | Present | 2.3/1 | 0.87/1 |
| Ex 7 | — | 0~64 | 10 | Absent | — | Absent | — | — |
| Ex 8 | — | 0~20 | 10 | Present/ FIG. 8 | 6.0 | Absent | — | — |
| Ex 9 | — | 0~18 | 10 | Present/ FIG. 8 | 6.0 | Absent | — | — |
| Ex 10 | — | 0~64 | 10 | Present/ FIG. 8 | 2.0 | Absent | — | — |
| Ex 11 | — | 0~64 | 10 | Present/ FIG. 8 | 94.7 | Absent | — | — |
| Ex 12 | — | 0~64 | 10 | Present/ FIG. 8 | 6.0 | Absent | — | — |
| Ex 13 | — | 0~64 | 10 | Present/ FIG. 8 | 6.0 | Absent | — | — |
| Ex 14 | — | 0~64 | 10 | Present/ FIG. 8 | 6.0 | Present | 2.3/1 | 0.87/1 |
| Ex 15 | — | 0~64 | 10 | Present/ FIG. 8 | 6.0 | Present | 2.3/1 | 0.87/1 |
| Ex 16 | 30% | 0~18 | 0 | Present/ FIG. 8 | 6.0 | Present | 2.3/1 | 0.87/1 |
| Ex 17 | 20% | 0~18 | 0 | Present/ FIG. 18 | 6.0 | Absent | — | — |
| Ex 18 | 30% | 0~18 | 0 | Absent | — | Present | 2.3/1 | 0.87/1 |
| Ex 19 | 30% | 0~18 | 0 | Absent | — | Absent | — | — |
| Ex 20 | 30% | 0~18 | 0 | Present/ FIG. 18 | 1.4 | Absent | — | — |
| Ex 21 | — | 0~64 | 60 | Absent | — | Absent | — | — |
| Ex 22 | — | 90~100 | 10 | Absent | — | Absent | — | — |
| Ex 23 | 80% | 0~64 | 0 | Present/ FIG. 18 | 6.0 | Absent | — | — |
| Ex 24 | 30% | 0~18 | 0 | Absent | — | Absent | — | — |
| Comp Ex 1 | — | 0~64 | — | Absent | — | Absent | — | — |
| Comp Ex 2 | — | — | 10 | Present/ FIG. 8 | 6.0 | Absent | — | — |
| Comp Ex 3 | — | — | 10 | Absent | — | Present | 2.3/1 | 0.87/1 |
| Comp Ex 4 | — | — | — | — | — | Present | — | — |

TABLE 1-continued

| | Distance of Junction of Sub-Wing Parts from Midpoint of Upper Edge of Front Part (%) | | First Strap Part and Second Strap Part Included in Shoulder Strap | Ratio of Elongational stress of Second Strap Part to First Strap Part S11/S10 | Adjuster | Ratio of Elongational stress of Adjuster to Second Strap PartS15/S11 |
|---|---|---|---|---|---|---|
| Ex 1 | 9~34 | 78~91 | Present | 18.8 | Present | 1.3 |
| Ex 2 | — | — | Present | 18.8 | Present | 1.3 |
| Ex 3 | 9~34 | 78~91 | Absent | — | Present | 1.3 |
| Ex 4 | — | — | Absent | — | Present | 1.3 |
| Ex 5 | 9~34 | 78~91 | Absent | — | Present | 1.3 |
| Ex 6 | 42~50 | 60~65 | Absent | — | Present | 1.3 |
| Ex 7 | — | — | Absent | — | Present | 1.3 |
| Ex 8 | — | — | Absent | — | Present | 1.3 |
| Ex 9 | — | — | Absent | — | Present | 1.3 |
| Ex 10 | — | — | Absent | — | Present | 1.3 |
| Ex 11 | — | — | Absent | — | Present | 1.3 |
| Ex 12 | — | — | Absent | — | Present | 1.3 |
| Ex 13 | — | — | Absent | — | Present | 1.3 |
| Ex 14 | 9~34 | 78~91 | Present | 1.9 | Present | 12.8 |
| Ex 15 | 9~34 | 78~91 | Present | 18.8 | Present | 0.4 |
| Ex 16 | 9~34 | 78~91 | Absent | — | Present | 1.3 |
| Ex 17 | — | — | Absent | — | Present | 1.3 |
| Ex 18 | 34~44 | 100 | Absent | — | Present | 1.3 |
| Ex 19 | — | — | Absent | — | Present | 1.3 |
| Ex 20 | — | — | Absent | — | Present | 1.3 |
| Ex 21 | — | — | Absent | — | Absent | — |
| Ex 22 | — | — | Absent | — | Absent | — |
| Ex 23 | — | — | Absent | — | Present | 1.3 |
| Ex 24 | — | — | Absent | — | Absent | — |
| Comp Ex 1 | — | — | Present | 18.8 | Present | 1.3 |
| Comp Ex 2 | — | — | Present | 18.8 | Present | 1.3 |
| Comp Ex 3 | 9~34 | 78~91 | Present | 18.8 | Present | 1.3 |
| Comp Ex 4 | — | — | — | — | — | — |

TABLE 2

| | Breast Movement During Limited-Gait Running (cm) | Breast Movement During Running (cm) | Maximum Pressure (kPa) | Comfort | Aesthetic |
|---|---|---|---|---|---|
| Ex 1 | 0.89 | 1.44 | 2.46 | 5.0 | 5.0 |
| Ex 2 | 0.92 | 1.49 | 2.90 | 4.7 | 5.0 |
| Ex 3 | 0.90 | 1.47 | 3.35 | 4.5 | 5.0 |
| Ex 4 | 0.98 | 1.55 | 3.43 | 4.0 | 5.0 |
| Ex 5 | 0.94 | 1.52 | 3.27 | 4.5 | 4.7 |
| Ex 6 | 0.93 | 1.51 | 3.40 | 4.5 | 4.5 |
| Ex 7 | 1.12 | 1.65 | 3.53 | 4.0 | 4.5 |
| Ex 8 | 1.10 | 1.66 | 3.23 | 4.5 | 4.7 |
| Ex 9 | 1.15 | 1.72 | 3.11 | 4.5 | 4.7 |
| Ex 10 | 1.06 | 1.58 | 3.24 | 4.3 | 4.7 |
| Ex 11 | 1.08 | 1.62 | 3.55 | 4.0 | 5.0 |
| Ex 12 | 1.14 | 1.70 | 2.99 | 4.0 | 4.0 |
| Ex 13 | 1.13 | 1.69 | 3.40 | 3.7 | 4.0 |
| Ex 14 | 0.97 | 1.55 | 2.79 | 4.5 | 4.7 |
| Ex 15 | 0.96 | 1.54 | 2.54 | 5.0 | 5.0 |
| Ex 16 | 1.01 | 1.55 | 3.15 | 4.7 | 5.0 |
| Ex 17 | 1.05 | 1.58 | 3.31 | 4.5 | 5.0 |
| Ex 18 | 1.02 | 1.57 | 3.08 | 4.7 | 5.0 |
| Ex 19 | 1.15 | 1.70 | 2.13 | 5.0 | 4.5 |
| Ex 20 | 1.13 | 1.66 | 2.33 | 5.0 | 4.5 |
| Ex 21 | 1.32 | 1.81 | 3.46 | 3.3 | 3.5 |
| Ex 22 | 1.35 | 1.85 | 2.25 | 4.0 | 4.0 |
| Ex 23 | 0.85 | 1.39 | 3.43 | 4.0 | 4.7 |
| Ex 24 | 1.17 | 1.71 | 3.32 | 3.7 | 3.7 |
| Comp Ex 1 | 1.42 | 1.94 | 2.79 | 3.5 | 1.5 |
| Comp Ex 2 | 1.36 | 1.87 | 3.01 | 3.5 | 2.5 |
| Comp Ex 3 | 1.45 | 1.97 | 3.97 | 2.5 | 2.0 |
| Comp Ex 4 | 2.35 | 4.89 | 3.50 | 3.0 | 4.7 |

As is clear from Table 2, when the brassieres produced in the Examples were worn, the breast movement mitigation effect during activity was significant, the maximum value of the applied pressure was small, and the comfort was also excellent. By separating the front part, which covers the breasts, into inner cup parts and a front cup part, and providing a reinforced part having a predetermined width in the front cup part, a brassiere which does not increase applied pressure when worn, even when used for sports, which can mitigate breast movement during activity, and which is excellent in comfort when worn while mitigating the sensation of movement could be obtained.

Though the embodiments of the present invention have been described above, the present invention is not limited thereto. Appropriate modifications can be made without deviating from the scope of the gist of the invention.

INDUSTRIAL APPLICABILITY

The brassiere of the present invention achieves both excellent movement mitigation properties and comfort, and can be widely used as a sports bra as well as a general brassiere.

REFERENCE SIGNS LIST

10 sports bra
11 front part
11*a* inner cup part
11*b* front cup part
12 shoulder strap
12*a* first strap part
12*b* second strap part

13 wing part
14 sub-wing part
15 rear part
16 connecting part
16*a* first connecting part
16*b* second connecting part
17 reinforced part
18 cup support part
19 adjuster
20 hook part
21 under-tape

The invention claimed is:

1. A brassiere comprising a front part which covers right and left breasts of a wearer, a pair of left and right shoulder straps which are connected to an upper part of the front part, and a pair of wing parts arranged on the left and right of the front part, wherein:

the front part comprises:

a pair of inner cup parts arranged on a side facing the wearer, and a front cup part arranged outside the inner cup parts, and the front part further comprises a reinforced part and a non-reinforced part, wherein the reinforced part has a predetermined width and covers a first area of the front part, and wherein the non-reinforced part includes a remaining area of the front part, and the ratio of elongational stress of the reinforced part of the front part to elongational stress of the non-reinforced part of the front part is 1.2/1 to 700/1.

2. The brassiere according to claim 1, wherein the reinforced part of the front part is disposed within the front cup part, and wherein the ratio of elongational stress of the reinforced part of the front cup part to elongational stress of the non-reinforced part of the front cup part is 2/1 to 700/1.

3. The brassiere according to claim 1, wherein the reinforced part of the front part is disposed within the inner cup parts, and wherein the ratio of elongational stress of the reinforced part of the inner cup parts to elongational stress of the non-reinforced part of the inner cup parts is 1.2/1 to 500/1.

4. The brassiere according to claim 1, wherein the reinforced part is arranged in the front cup part or the inner cup parts such that the reinforced part is disposed at least above a midpoint of a line segment connecting a midpoint of an upper edge of the front cup part or the inner cup parts and a midpoint of a lower edge of the front cup part or the inner cup parts, and wherein the reinforced part occupies at least 10% of an area of an upper part of the front cup part or the inner cup parts.

5. The brassiere according to claim 1, further comprising:

first connection positions disposed where each of the left and right shoulder portions connect to the front part, second connection positions disposed where each of the left and right wing parts connect to the front part, and curves extending between respective first connection positions and upper points of second connection positions, wherein junctions between the front cup part and the inner cup parts are disposed in at least 0 to 50% of positions along the curves.

6. The brassiere according to claim 1, comprising a cup support part arranged outside of the inner cup parts, and wherein the ratio of elongational stress of the cup support part to elongational stress of the non-reinforced part of the inner cup parts is 1/1 to 500/1.

7. The brassiere according to claim 1, comprising a rear part which connects the shoulder straps and the wing parts on a back side of the wearer.

8. The brassiere according to claim 1, further comprising sub-wing parts extending from a side edge part of the front part toward a rear area and overlapping the wing parts, and the ratio of elongational stress of the sub-wing parts to elongational stress of the wing parts is 0.7/1 to 10/1.

9. The brassiere according to claim 8, wherein the sub-wing parts are disposed outside the wing parts with respect to the front cup art.

10. The brassiere according to claim 8, wherein the sub-wing parts are arranged in the brassiere so as to maximize a length of a line segment connecting a midpoint of an upper edge of the front part and a midpoint of an upper edge of a connection site between the shoulder straps and the wing parts on a back side of the wearer, and wherein a plane extends in a normal direction relative to the line segment, further comprising a junction between the sub-wing parts and one of the front part, the wing parts, the rear part, a hook part, or an under-tape, wherein the junction is present in 0 to 40% of positions on the plane from the midpoint of the upper part of the front part of the line segment toward the midpoint of the upper edge of the connection site, and 70 to 100% of positions on the plane, and the sub-wing parts have areas which are not connected with the wing parts.

11. The brassiere according to claim 10, wherein the sub-wing parts are arranged in the brassiere so as to maximize the length of a line segment connecting a midpoint of the upper edge of the front part with a midpoint of the upper edge of the connection site, wherein, when a plane extending in a normal direction relative to the line segment is defined, a junction between the sub-wing parts and one of the front part, the wing parts, or the rear part is formed, wherein the junction is disposed on the plane in 0 to 40% of positions from the midpoint of the upper edge of the front part on the line segment toward the midpoint of the upper edge of the connection side, and wherein the junction is disposed on 70 to 100% of positions on the plane, and wherein the sub-wing parts have areas which are not connected with the wing parts.

12. The brassiere according to claim 11, wherein a ratio of elongational stress of the rear part to elongational stress of the sub-wing parts is at least 0.7/1.

13. The brassiere according to claim 1, wherein the shoulder straps include cylindrical first strap parts and tapered second strap parts arranged inside the first strap parts, first ends of the first strap parts are connected with the front cup part, and first ends of the second strap parts are directly or indirectly connected with the inner cup parts, and second ends of the first strap parts are connected with second ends or portions of the second strap parts.

14. The brassiere according to claim 13, wherein a ratio of elongational stress of the second strap parts to elongational stress of the first strap parts is 1.2/1 to 30/1.

15. The brassiere according to claim 1 wherein the brassiere is a sports bra.

16. The brassiere according to claim 9, wherein the sub-wing parts are arranged in the brassiere so as to maximize a length of a line segment connecting a midpoint of an upper edge of the front part and a midpoint of an upper edge of a connection site between the shoulder straps and the wing parts on a back side of the wearer, and wherein, when a plane extending in a normal direction relative to the line segment is defined, a junction between the sub-wing parts and at least one of the front part, the wing parts, the rear part, a hook part, or an under-tape is formed, wherein the junction is formed in 0 to 40% of positions on the plane from the midpoint of the upper part of the front part of the line segment toward the midpoint of the upper edge of the connection site, and 70 to 100% of positions on the plane, and wherein the sub-wing parts have areas which are not connected with the wing parts.

17. The brassiere according to claim 15, wherein the sub-wing parts are arranged in the brassiere so as to maximize a length of a line segment connecting a midpoint of an upper edge of the front part and a midpoint of an upper edge of a connection site between the shoulder straps and the wing parts on a back side of the wearer, and wherein, when a plane extending in a normal direction relative to the line segment is defined, a junction between the sub-wing parts and at least one of the front part, the wing parts, the rear part, a hook part, or an under-tape is formed, wherein the junction is formed in 0 to 40% of positions on the plane from the midpoint of the upper part of the front part of the line segment toward the midpoint of the upper edge of the connection site, and 70 to 100% of positions on the plane, and wherein the sub-wing parts have areas which are not connected with the wing parts.

18. The brassiere according to claim 17, wherein a ratio of elongational stress of the rear part to elongational stress of the sub-wing parts is at least 0.7/1.

* * * * *